US011465410B2

(12) United States Patent
Furukawa

(10) Patent No.: US 11,465,410 B2
(45) Date of Patent: Oct. 11, 2022

(54) PRINT HEAD, LIQUID EJECTING APPARATUS, AND CAPACITIVE LOAD DRIVE INTEGRATED CIRCUIT APPARATUS

(71) Applicant: SEIKO EPSON CORPORATION, Tokyo (JP)

(72) Inventor: Ryota Furukawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 66 days.

(21) Appl. No.: 17/210,655

(22) Filed: Mar. 24, 2021

(65) Prior Publication Data

US 2021/0300029 A1 Sep. 30, 2021

(30) Foreign Application Priority Data

Mar. 26, 2020 (JP) ..... JP2020-055864

(51) Int. Cl.
*B41J 2/45* (2006.01)
*B41J 2/045* (2006.01)

(52) U.S. Cl.
CPC ..... *B41J 2/04541* (2013.01); *B41J 2/04581* (2013.01)

(58) Field of Classification Search
CPC ... B41J 2/04525; B41J 2/0455; B41J 2/04541
See application file for complete search history.

(56) References Cited

U.S. PATENT DOCUMENTS

| | | | | |
|---|---|---|---|---|
| 9,126,406 | B1 * | 9/2015 | Furukawa | B41J 2/04596 |
| 2015/0231879 | A1 | 8/2015 | Furukawa | |
| 2015/0251415 | A1 * | 9/2015 | Takagi | B41J 2/04595 347/10 |
| 2018/0111368 | A1 * | 4/2018 | Chikamoto | B41J 2/14201 |
| 2019/0009525 | A1 * | 1/2019 | Yamada | B41J 2/04593 |
| 2020/0406610 | A1 * | 12/2020 | Yamada | B41J 2/04596 |

FOREIGN PATENT DOCUMENTS

JP 2015-150844 A 8/2015

* cited by examiner

*Primary Examiner* — Shelby L Fidler
(74) *Attorney, Agent, or Firm* — Global IP Counselors, LLP

(57) ABSTRACT

A print head includes: an integrated circuit apparatus that switches whether or not to supply drive signals to a plurality of piezoelectric elements, and includes a first circuit block that switches whether or not to supply the drive signal, a second circuit block that switches whether or not to supply the drive signal, a third circuit block that switches whether or not to supply the drive signal, a fourth circuit block, and a first buffer area, a second buffer area, and a third buffer area in which no circuit element is located, in which the first buffer area is located between the first circuit block and the fourth circuit block, the second buffer area is located between the second circuit block and the fourth circuit block, and the third buffer area is located between the third circuit block and the fourth circuit block.

9 Claims, 12 Drawing Sheets

FIG. 6

| SI (b1,B2,B3) | Ts1 | | | Ts2 | | |
|---|---|---|---|---|---|---|
| | Sa | Sb | Sc | Sa | Sb | Sc |
| (1,1,0) | H | L | L | H | L | L |
| (1,0,0) | H | L | L | L | H | L |
| (0,1,0) | L | H | L | H | L | L |
| (0,0,0) | L | H | L | L | H | L |
| (0,0,1) | L | L | H | L | L | H |

PRINT HEAD, LIQUID EJECTING APPARATUS, AND CAPACITIVE LOAD DRIVE INTEGRATED CIRCUIT APPARATUS

The present application is based on, and claims priority from JP Application Serial Number 2020-055864, filed Mar. 26, 2020, the disclosure of which is hereby incorporated by reference herein in its entirety.

BACKGROUND

1. Technical Field

The present disclosure relates to a print head, a liquid ejecting apparatus, and a capacitive load drive integrated circuit apparatus.

2. Related Art

An ink jet printer (a liquid ejecting apparatus) which ejects ink as a liquid to print an image or a document is known to use a capacitive load such as a piezoelectric element. In such a liquid ejecting apparatus, the piezoelectric element is provided corresponding to each of a plurality of nozzles in a print head which ejects ink. When a drive signal is supplied to the piezoelectric element at a predetermined timing, the piezoelectric element is driven, and a predetermined amount of ink is ejected from the corresponding nozzle as the piezoelectric element is driven, so that a desired image, document, or the like is formed at a medium.

In such a liquid ejecting apparatus, the print head includes the plurality of nozzles corresponding to a plurality of piezoelectric elements and an integrated circuit apparatus which controls an output of the drive signal to be supplied to the plurality of piezoelectric elements. The number of terminals for outputting the drive signal of this integrated circuit apparatus is increased with an increase in the number of nozzles of the print head in recent years.

JP-A-2015-150844 discloses a technique of reducing a possibility that in a print head including a semiconductor apparatus (an integrated circuit apparatus) which controls an output of a drive signal for ejecting ink from a plurality of nozzles, even when the number of nozzles of the print head is increased, the semiconductor apparatus becomes large.

In recent years, a market demand for improving productivity of the liquid ejecting apparatus is handled by increasing the amount of ink ejected by the print head. Meanwhile, in order to increase the amount of ink ejected from the print head, it is necessary to supply a large current to a capacitive load such as a piezoelectric element, so that the large current is supplied to the integrated circuit apparatus. When the amount of current supplied to the integrated circuit apparatus is increased, a noise component caused by the current increases, and as a result, the integrated circuit apparatus may malfunction. Meanwhile, there is no description in JP-A-2015-150844 regarding the malfunction of the integrated circuit apparatus which may occur due to the market demand for productivity improvement, and there is room for improvement.

SUMMARY

According to an aspect of the present disclosure, there is provided a print head including: a plurality of piezoelectric elements to be driven by supply of drive signals; an integrated circuit apparatus that switches whether or not to supply the drive signal to the plurality of piezoelectric elements; and a wiring substrate in which the drive signal propagates and the integrated circuit apparatus is provided, in which the integrated circuit apparatus includes a first side, a second side located facing the first side, a first terminal group located along the first side and electrically coupled to a first piezoelectric element group including a first piezoelectric element among the plurality of piezoelectric elements, a second terminal group located along the second side and electrically coupled to a second piezoelectric element group including a second piezoelectric element among the plurality of piezoelectric elements, a third terminal group located along the second side and electrically coupled to a third piezoelectric element group including a third piezoelectric element among the plurality of piezoelectric elements, a fourth terminal group located between the second terminal group and the third terminal group along the second side and including an input terminal and an output terminal, a first circuit block that switches whether or not to supply the drive signal from the first terminal group to the first piezoelectric element group, a second circuit block that switches whether or not to supply the drive signal from the second terminal group to the second piezoelectric element group, a third circuit block that switches whether or not to supply the drive signal from the third terminal group to the third piezoelectric element group, a fourth circuit block that operates according to a signal input from the input terminal or outputs a signal from the output terminal, and a first buffer area, a second buffer area, and a third buffer area in which no circuit element is located, the first buffer area is located between the first circuit block and the fourth circuit block, the second buffer area is located between the second circuit block and the fourth circuit block, and the third buffer area is located between the third circuit block and the fourth circuit block.

According to another aspect of the present disclosure, there is provided a liquid ejecting apparatus including: a drive signal output circuit that outputs drive signals; and a print head that ejects liquid based on the drive signal, in which the print head includes a plurality of piezoelectric elements to be driven by supply of the drive signals, an integrated circuit apparatus that switches whether or not to supply the drive signal to the plurality of piezoelectric elements, and a wiring substrate in which the drive signal propagates and the integrated circuit apparatus is provided, the integrated circuit apparatus includes a first side, a second side located facing the first side, a first terminal group located along the first side and electrically coupled to a first piezoelectric element group including a first piezoelectric element among the plurality of piezoelectric elements, a second terminal group located along the second side and electrically coupled to a second piezoelectric element group including a second piezoelectric element among the plurality of piezoelectric elements, a third terminal group located along the second side and electrically coupled to a third piezoelectric element group including a third piezoelectric element among the plurality of piezoelectric elements, a fourth terminal group located between the second terminal group and the third terminal group along the second side and including an input terminal and an output terminal, a first circuit block that switches whether or not to supply the drive signal from the first terminal group to the first piezoelectric element group, a second circuit block that switches whether or not to supply the drive signal from the second terminal group to the second piezoelectric element group, a third circuit block that switches whether or not to supply the drive signal from the third terminal group to the third piezoelectric element group, a fourth circuit block that operates according to a signal input from the input terminal or outputs a signal from the output terminal, and a first buffer area, a second buffer area, and a third buffer area in which no circuit element is located, the first buffer area is located between the first circuit block and the fourth circuit block, the second buffer area is located between the second circuit block and the fourth circuit block, and the third buffer area is located between the third circuit block and the fourth circuit block.

According to still another aspect of the present disclosure, there is provided a capacitive load drive integrated circuit apparatus which switches whether or not to supply drive signals to a plurality of capacitive loads to be driven by supply of the drive signals to control driving of the plurality of capacitive loads, the capacitive load drive integrated circuit apparatus including: a first side; a second side located facing the first side; a first terminal group located along the first side and electrically coupled to a first capacitive load group including a first capacitive load among the plurality of capacitive loads; a second terminal group located along the second side and electrically coupled to a second capacitive load group including a second capacitive load among the plurality of capacitive loads; a third terminal group located along the second side and electrically coupled to a third capacitive load group including a third capacitive load among the plurality of capacitive loads; a fourth terminal group located between the second terminal group and the third terminal group along the second side and including an input terminal and an output terminal; a first circuit block that switches whether or not to supply the drive signal from the first terminal group to the first capacitive load group; a second circuit block that switches whether or not to supply the drive signal from the second terminal group to the second capacitive load group; a third circuit block that switches whether or not to supply the drive signal from the third terminal group to the third capacitive load group; a fourth circuit block that operates according to a signal input from the input terminal or outputs a signal from the output terminal; and a first buffer area, a second buffer area, and a third buffer area in which no circuit element is located, the first buffer area is located between the first circuit block and the fourth circuit block, the second buffer area is located between the second circuit block and the fourth circuit block, and the third buffer area is located between the third circuit block and the fourth circuit block.

BRIEF DESCRIPTION OF THE DRAWINGS

FIG. 6 is a diagram illustrating contents of decoding performed by a decoder.

DESCRIPTION OF EXEMPLARY EMBODIMENTS

Hereinafter, appropriate embodiments of the present disclosure will be described with reference to drawings. The used drawings are for convenience of explanation. The embodiments to be described below do not unfairly limit contents of the present disclosure described in the claims. In addition, all of configurations to be described below are not essential components of the disclosure.

1. Overview of Liquid Ejecting Apparatus

Figure 1:
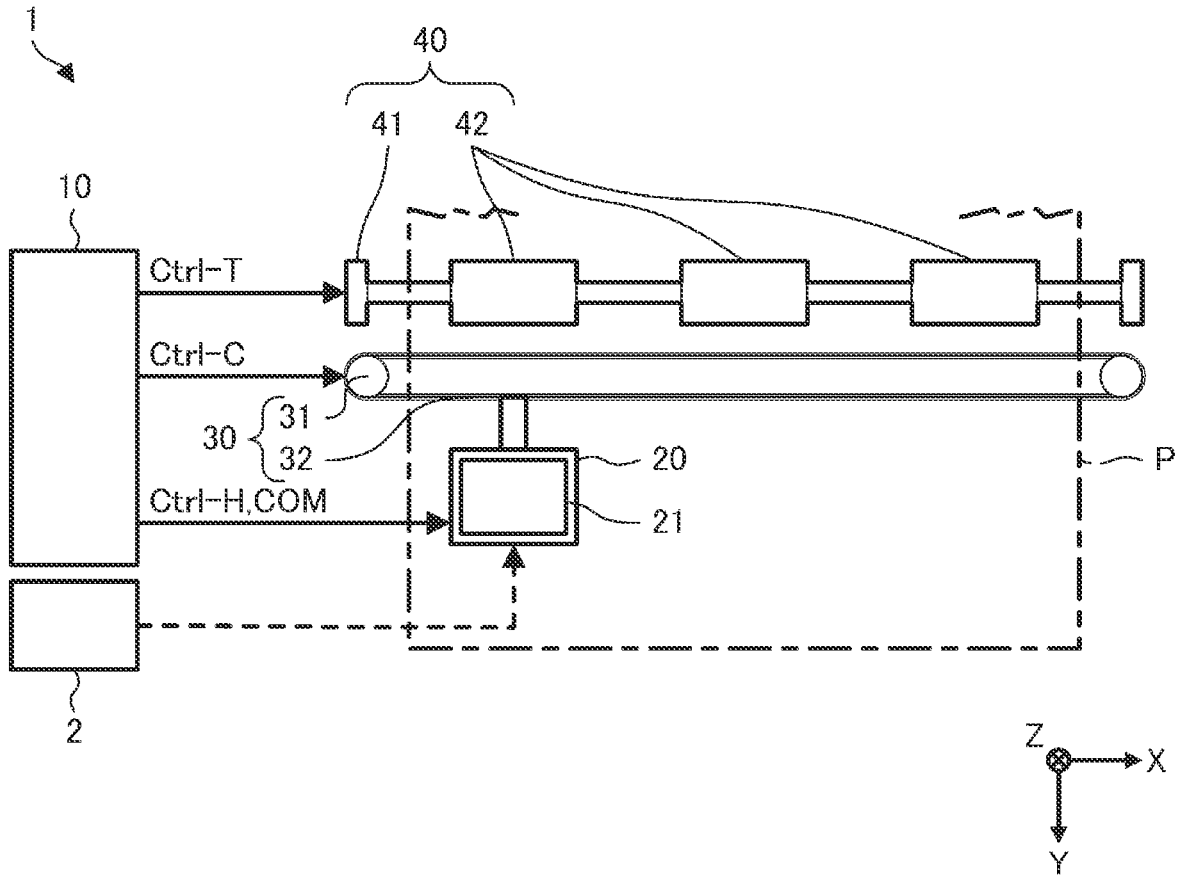
FIG. 1 is a diagram illustrating a schematic configuration of a liquid ejecting apparatus.

FIG. 1 is a diagram illustrating a schematic configuration of a liquid ejecting apparatus 1. The liquid ejecting apparatus 1 is a serial printing type ink jet printer in which a carriage 20 at which a print head 21 for ejecting ink as an example of a liquid is mounted reciprocates and the ink is ejected to a medium P to be transported so as to form an image on the medium P. In the following description, a direction in which the carriage 20 reciprocates is an X-direction, a direction in which the medium P is transported is a Y-direction, and a direction in which the ink is ejected is a Z-direction. Although the X-direction, the Y-direction, and the Z-direction will be described as being orthogonal to each other, the description is not limited to the fact that the various configurations constituting the liquid ejecting apparatus 1 are provided orthogonally. Further, as the medium P, any printing target such as printing paper, a resin film, or cloth can be used. Here, in the following description, a direction along the Y-direction in which the medium P is transported is referred to as a transport direction, a direction, which is a direction intersecting the transport direction in which the medium P is transported, is along the X-direction in which the carriage 20 reciprocates to scan the medium P is referred to as a main scanning direction, and a direction, which is a direction intersecting both the transport direction and the main scanning direction, is along the Y-direction in which the ink is ejected to the medium P is referred to as an ejection direction.

The liquid ejecting apparatus 1 includes a liquid container 2, a control mechanism 10, a carriage 20, a movement mechanism 30, and a transport mechanism 40.

The liquid container 2 stores a plurality of types of ink to be ejected to the medium P. Examples of a color of the ink stored in the liquid container 2 include black, cyan, magenta, yellow, red, and gray. Further, as the liquid container 2 in which such ink is stored, an ink cartridge, a bag-shaped ink pack formed of a flexible film, an ink tank configured to replenish ink, and the like are used.

The control mechanism 10 includes, for example, a processing circuit such as a Central Processing Unit (CPU) or a field programmable gate array (FPGA) and a storage circuit such as a semiconductor memory, and controls each element of the liquid ejecting apparatus 1.

The print head 21 is mounted at the carriage 20. Further, the carriage 20 is fixed to an endless belt 32 included in the movement mechanism 30. The liquid container 2 may be mounted at the carriage 20.

A control signal Ctrl-H for controlling the print head 21 output by the control mechanism 10 and one or a plurality of drive signals COM for driving the print head 21 are input to the print head 21. The print head 21 ejects the ink supplied from the liquid container 2 along the Z-direction, which is the ejection direction, based on the control signal Ctrl-H and the drive signal COM.

The movement mechanism 30 includes a carriage motor 31 and the endless belt 32. The carriage motor 31 operates based on a control signal Ctrl-C input from the control mechanism 10. The endless belt 32 rotates according to an operation of the carriage motor 31. As a result, the carriage 20 fixed to the endless belt 32 reciprocates along the X-direction.

The transport mechanism 40 includes a transport motor 41 and a transport roller 42. The transport motor 41 operates based on a control signal Ctrl-T input from the control mechanism 10. The transport roller 42 rotates according to an operation of the transport motor 41. As the transport roller 42 rotates, the medium P is transported along the Y-direction, which is the transport direction.

As described above, the liquid ejecting apparatus 1 ejects the ink from the print head 21 mounted at the carriage 20 in conjunction with the transporting of the medium P by the transport mechanism 40 and the reciprocation of the carriage 20 by the movement mechanism 30 so as to land the ink at a predetermined position on a surface of the medium P and form a desired image on the medium P.

2. Functional Configuration of Liquid Ejecting Apparatus

Figure 2:
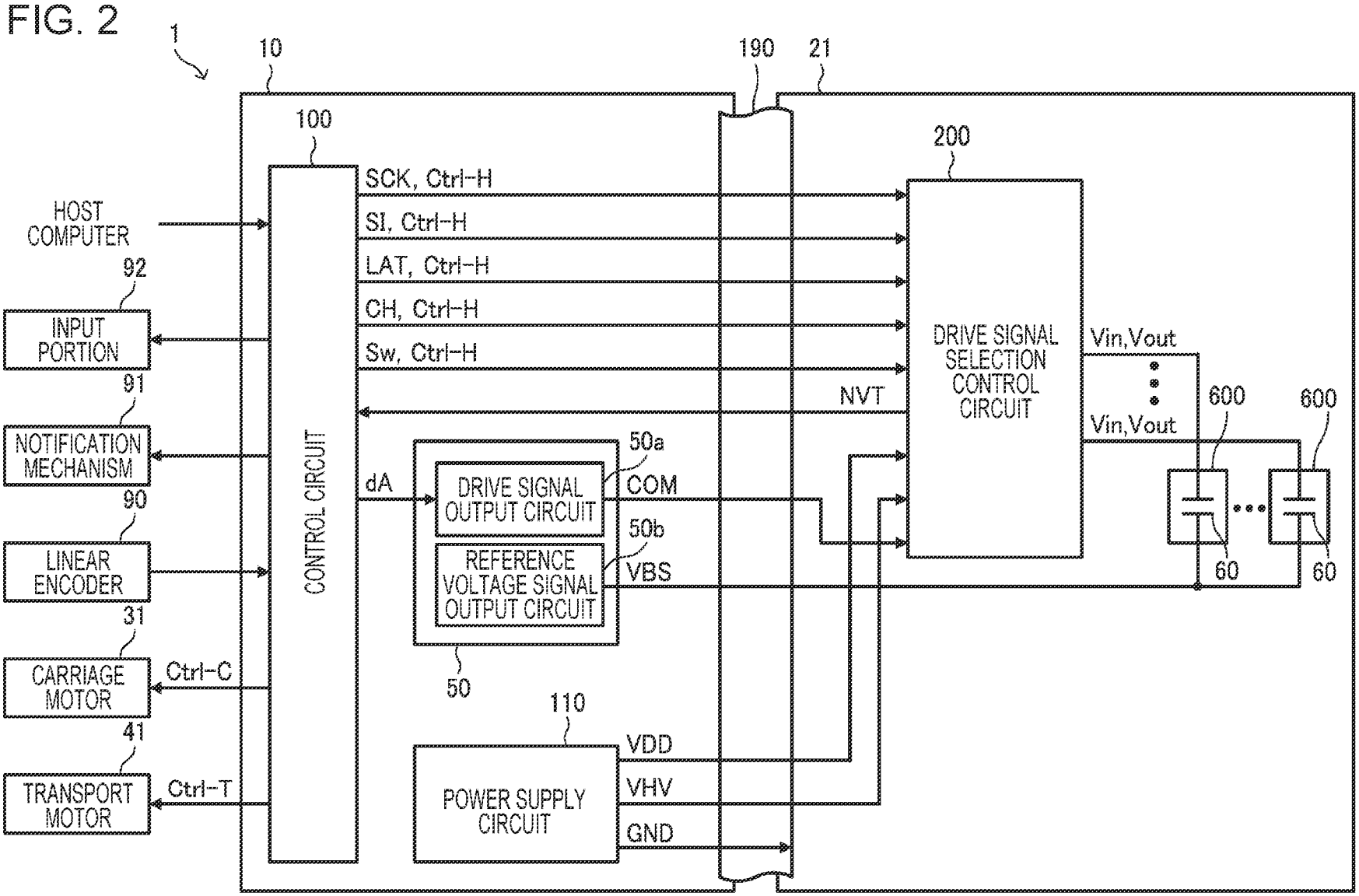
FIG. 2 is a diagram illustrating a functional configuration of the liquid ejecting apparatus.

FIG. 2 is a diagram illustrating a functional configuration of the liquid ejecting apparatus 1. The liquid ejecting apparatus 1 includes the control mechanism 10, the print head 21, the carriage motor 31, the transport motor 41, a linear encoder 90, a notification mechanism 91, an input portion 92, and a cable 190.

The cable 190 electrically couples the control mechanism 10 and the print head 21, and transmits various signals propagating between the control mechanism 10 and the print head 21. Here, as described above, the print head 21 is mounted at the carriage 20 and reciprocates along the X-direction. As such a cable 190, a flexible flat cable (FFC) or the like in which a plurality of signal lines are provided side by side substantially in parallel with a smoke-saving exercise is used.

The input portion 92 includes a switch (not illustrated) for a user to operate the liquid ejecting apparatus 1. Various commands for the user to operate the liquid ejecting apparatus 1 are input to the input portion 92 via the switch. The command input to the input portion 92 is input to the control mechanism 10. Information indicating a state of the liquid ejecting apparatus 1 is input from the control mechanism 10 to the notification mechanism 91. Further, the notification mechanism 91 notifies the user of the information indicating the state of the liquid ejecting apparatus 1 based on the input information. The notification mechanism 91 may be, for example, a liquid crystal panel or the like, or may be an indicator lamp using an LED, an incandescent lamp or the like. Further, the notification mechanism 91 may be configured to notify the user by voice or vibration. Here, the input portion 92 and the notification mechanism 91 may be integrally formed in the same manner as a touch panel or the like.

The control mechanism 10 includes a drive circuit 50, a control circuit 100, and a power supply circuit 110. The control circuit 100 includes a processor such as a microcontroller, for example. The control circuit 100 generates and outputs data and various signals for controlling the liquid ejecting apparatus 1 based on various signals such as image data input from a host computer, the input portion 92, or the like.

The operation of the control circuit 100 will be described in detail. The control circuit 100 grasps a scanning position of the print head 21 based on a detection signal input from the linear encoder 90. The control circuit 100 generates and outputs various signals according to the scanning position of the print head 21. Specifically, the control circuit 100 generates the control signal Ctrl-C for controlling reciprocation of the print head 21 mounted at the carriage 20, and outputs the control signal Ctrl-C to the carriage motor 31. Further, the control circuit 100 generates the control signal Ctrl-T for controlling transport of the medium P, and outputs the control signal Ctrl-T to the transport motor 41. The control signal Ctrl-C may be input to the carriage motor 31 after being signal-converted via a driver circuit (not illustrated). In the same manner, the control signal Ctrl-T may be input to the transport motor 41 after being signal-converted via the driver circuit (not illustrated).

Further, the control circuit 100 outputs a drive control signal dA, which is a digital signal, to the drive circuit 50.

The drive circuit 50 includes a drive signal output circuit **50*a* and a reference voltage signal output circuit 50*b*. The drive control signal dA is input to the drive signal output circuit 50*a*. The drive signal output circuit 50*a* generates the drive signal COM by performing digital to analog signal conversion on the drive control signal dA and then amplifying the converted analog signal in class D. That is, the drive control signal dA is a digital signal which defines a waveform of the drive signal COM, and the drive signal output circuit 50*a* generates the drive signal COM by amplifying the waveform defined by the drive control signal dA in class D and outputs the drive signal COM to the print head 21. Therefore, the drive control signal dA may be any signal as long as the signal can define the waveform of the drive signal COM, and may be an analog signal. Further, the drive signal output circuit 50*a* may be a class A amplifier circuit, a class B amplifier circuit, a class AB amplifier circuit, or the like, as long as the drive signal output circuit 50*a*** can amplify the waveform defined by the drive control signal dA.

The reference voltage signal output circuit **50*b* generates a reference voltage signal VBS indicating a reference potential of the drive signal COM and outputs a reference voltage signal VBS to the print head 21**. The reference voltage signal VBS may be, for example, a signal having a ground potential having a voltage value of 0 V, or a signal having a direct current voltage having a voltage value of 5.5 V, 6 V, or the like.

The power supply circuit 110 generates voltages VHV and VDD, and a ground signal GND. The voltage VHV is a direct current voltage signal having a voltage value of, for example, 42 V. Further, the voltage VDD is a signal of a direct current voltage having a voltage value of, for example, 3.3 V. The ground signal GND is a signal indicating a reference potential of the voltages VHV and VDD, and is, for example, a signal having a ground potential having a voltage value of 0 V. The voltage VHV is used as a voltage for amplification in the drive signal output circuit **50*a*, and the voltage VDD is used as a power supply voltage, a control voltage, or the like of various configurations in the control mechanism 10. Further, the voltages VHV and VDD, and the ground signal GND are also output to the print head 21. The voltage values of the voltages VHV and VDD, and the ground signal GND are not limited to the above 42 V, 3.3 V, and 0 V. Further, the power supply circuit 110** may generate and output signals having a plurality of voltage values other than the voltages VHV and VDD, and the ground signal GND.

Further, based on various signals such as image data input from the host computer and the scanning position of the print head 21 detected by the linear encoder 90 and the like, the control circuit 100 generates a print data signal SI, a change signal CH, a latch signal LAT, a clock signal SCK, and a switching control signal Sw, and outputs the print data signal SI, the change signal CH, the latch signal LAT, the clock signal SCK, and the switching control signal Sw to the print head 21, as the control signal Ctrl-H for controlling the print head 21.

The print head 21 includes a drive signal selection control circuit 200 and a plurality of ejecting portions 600.

The voltages VHV and VDD, the drive signal COM, the print data signal SI, the clock signal SCK, the latch signal LAT, the change signal CH, and the switching control signal Sw are input to the drive signal selection control circuit 200. The voltages VHV and VDD function as a power supply voltage and a control voltage of the drive signal selection control circuit 200. Based on the input print data signal SI, clock signal SCK, latch signal LAT, change signal CH, and switching control signal Sw, the drive signal selection control circuit 200 generates a drive signal Vin by selecting or not selecting a voltage waveform included in the drive signal COM, and supplies the drive signal Vin to one end of the piezoelectric element 60 included in the corresponding ejecting portion 600. The reference voltage signal VBS is supplied to the other end of the piezoelectric element 60. The piezoelectric element 60 is driven by a potential difference between the drive signal Vin and the reference voltage signal VBS. The amount of ink according to the drive of the piezoelectric element 60 is ejected from the ejecting portion 600.

Further, a residual vibration Vout generated after the piezoelectric element 60 is driven by supplying the drive signal Vin is input to the drive signal selection control circuit 200. The drive signal selection control circuit 200 generates a residual vibration signal NVT according to the residual vibration Vout and outputs the residual vibration signal NVT to the control circuit 100. Details of the drive signal selection control circuit 200 will be described below.

Figure 3:
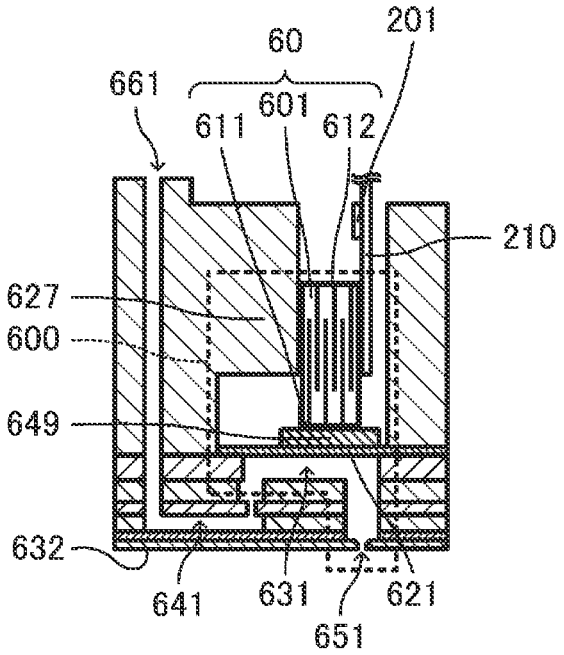
FIG. 3 is a diagram illustrating a schematic configuration of an ejecting portion.

Here, an example of a configuration of the ejecting portion 600 will be described with reference to FIG. 3. FIG. 3 is a diagram illustrating a schematic configuration of the ejecting portion 600. As illustrated in FIG. 3, the ejecting portion 600 includes the piezoelectric element 60, a diaphragm 621, a cavity 631, and a nozzle 651.

The piezoelectric element 60 is a laminated piezoelectric vibrator in which a piezoelectric body 601 is interposed between electrodes 611 and 612 and laminated, and cut into elongated comb-teeth shapes. The drive signal Vin is supplied to the electrode 611 from the drive signal selection control circuit 200. Further, the reference voltage signal VBS is supplied to the electrode 612. The piezoelectric element 60 is driven according to a potential difference between the drive signal Vin supplied to the electrode 611 and the reference voltage signal VBS supplied to the electrode 612. Specifically, the piezoelectric element 60 is displaced in a longitudinal direction of the piezoelectric element 60 which is a vertical direction illustrated in FIG. 3. That is, the piezoelectric element 60 according to the present embodiment is a so-called longitudinal vibration type piezoelectric vibrator. Further, a fixed end portion of the piezoelectric element 60 is joined to the fixed portion 627, and a free end portion of the piezoelectric element 60 projects outward from a tip edge of the fixed portion 627. That is, in the ejecting portion 600, the piezoelectric element 60 is provided in a so-called cantilever state. A tip surface of the free end portion of the piezoelectric element 60 is joined to an island portion 649 provided above the diaphragm 621.

The diaphragm 621 is located below the island portion 649 in FIG. 3. The diaphragm 621 is deformed with the displacement of the piezoelectric element 60 provided via the island portion 649. Further, the cavity 631 is provided below the diaphragm 621. That is, the diaphragm 621 functions as a diaphragm which enlarges and reduces an internal volume of the cavity 631 by being deformed with the displacement of the piezoelectric element 60. An inside of the cavity 631 is filled with ink supplied via the ink supply port 661 and the reservoir 641. The nozzle 651 is formed at the nozzle plate 632, and is an opening portion communicating with the cavity 631.

In the ejecting portion 600 configured as described above, the diaphragm 621 is deformed according to the displacement of the piezoelectric element 60, and the internal volume of the cavity 631 changes according to the deformation of the diaphragm 621. As a result, an internal pressure of the cavity 631 changes, and the ink stored in the cavity 631 is ejected from the nozzle 651.

Here, the drive signal selection control circuit 200 is mounted at the integrated circuit 201. As illustrated in FIG. 3, the integrated circuit 201 at which the drive signal selection control circuit 200 is mounted is provided in a flexible printed circuit (FPC) 210. That is, the integrated circuit 201 at which the drive signal selection control circuit 200 is mounted switches whether or not to supply the drive signal COM to the piezoelectric element 60 as the drive signal Vin. The integrated circuit 201 is an example of an integrated circuit apparatus, and more specifically, a capacitive load drive integrated circuit apparatus which drives the piezoelectric element 60 as an example of a capacitive load. The drive signal COM input to the drive signal selection control circuit 200 mounted at the integrated circuit 201 and the drive signal Vin output by the drive signal selection control circuit 200 propagate to the FPC 210. The FPC 210 to which the drive signal COM and the drive signal Vin are propagated and in which the integrated circuit 201 is provided is an example of a wiring substrate.

3. Circuit Configuration of Drive Signal Selection Control Circuit

Figure 4:
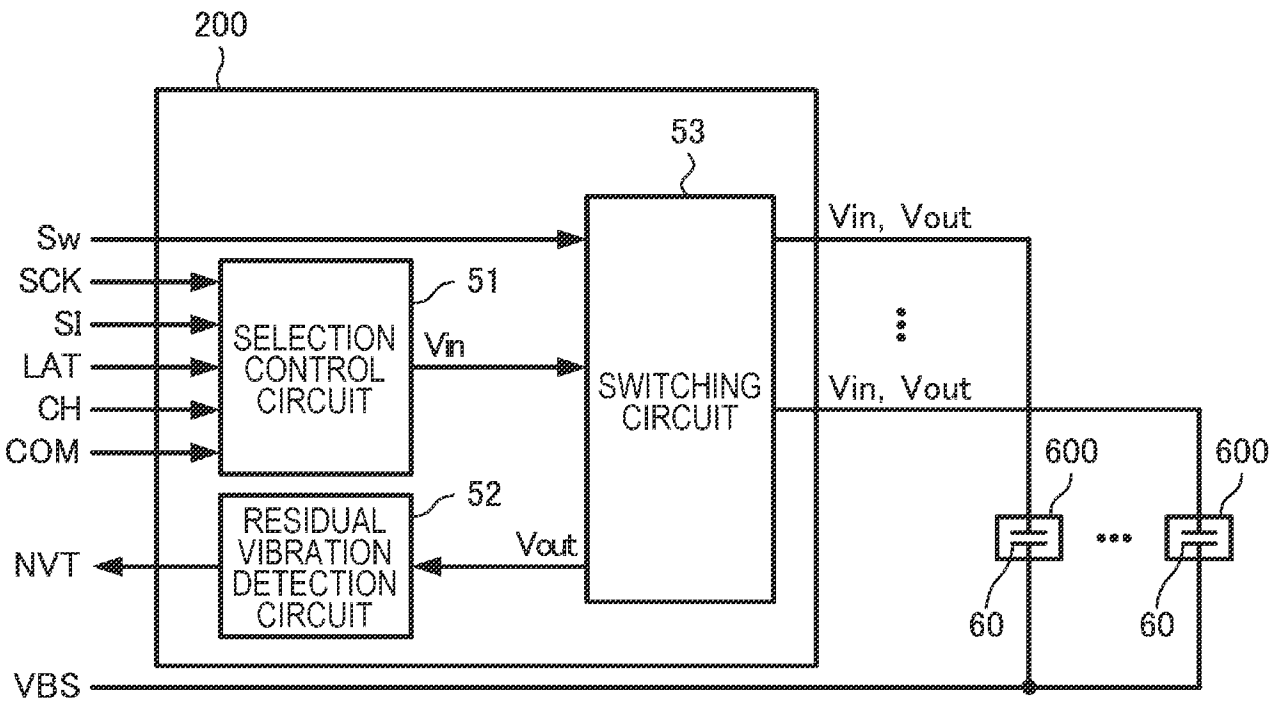
FIG. 4 is a diagram illustrating a circuit configuration of a drive signal selection control circuit.

Next, a circuit configuration and an operation of the drive signal selection control circuit 200 will be described. FIG. 4 is a diagram illustrating a circuit configuration of the drive signal selection control circuit 200. The drive signal selection control circuit 200 includes a selection control circuit 51, a residual vibration detection circuit 52, and a switching circuit 53.

The clock signal SCK, the print data signal SI, the latch signal LAT, the change signal CH, and the drive signal COM output from the drive signal output circuit **50*a* are input to the selection control circuit 51. The selection control circuit 51 generates the drive signal Vin based on the clock signal SCK, the print data signal SI, the latch signal LAT, and the change signal CH, and the drive signal COM, and outputs the drive signal Vin to the switching circuit 53. Specifically, the selection control circuit 51 selects or does not select a signal waveform included in the drive signal COM based on the clock signal SCK, the print data signal SI, the latch signal LAT, and the change signal CH so as to generate the drive signal Vin and supply the drive signal Vin to the piezoelectric element 60 included in the corresponding ejecting portion 600. Here, the drive signal COM output by the drive signal output circuit 50*a* is an example of a drive signal. Further, the drive signal Vin generated by the drive signal selection control circuit 200** selecting or not selecting the signal waveform included in the drive signal COM is also an example of the drive signal.

Based on the switching control signal Sw, the switching circuit 53 switches whether or not to supply the drive signal Vin to the corresponding piezoelectric element 60 or to supply the residual vibration Vout generated in the piezoelectric element 60 to the residual vibration detection circuit 52 after supplying the drive signal Vin to the piezoelectric element 60. In other words, the switching circuit 53 switches whether or not to electrically couple the corresponding piezoelectric element 60 and the selection control circuit 51 or to electrically couple the piezoelectric element 60 and the residual vibration detection circuit 52.

The residual vibration detection circuit 52 detects the input residual vibration Vout. The residual vibration detection circuit 52 generates the residual vibration signal NVT based on the detected residual vibration Vout and outputs the residual vibration signal NVT to the control circuit 100. In other words, the residual vibration detection circuit 52 generates the residual vibration signal NVT based on the residual vibration Vout generated by driving the piezoelectric element 60.

Figure 5:
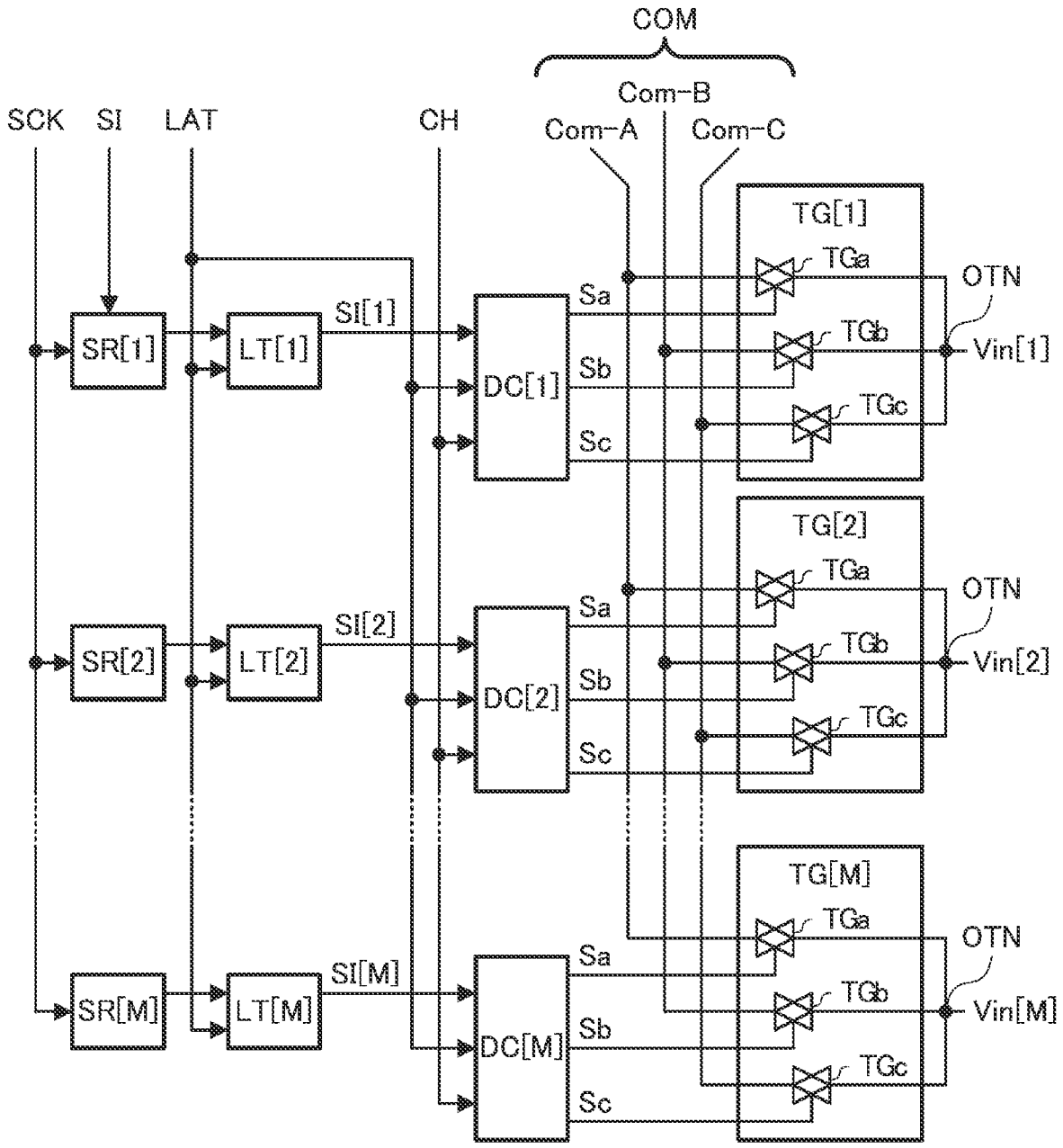
FIG. 5 is a diagram illustrating an electrical configuration of a selection control circuit.

First, a specific example of a configuration and an operation of the selection control circuit 51 will be described with reference to FIGS. 5 to 8. FIG. 5 is a diagram illustrating an electrical configuration of the selection control circuit 51. As illustrated in FIG. 5, the selection control circuit 51 has M sets corresponding to the M ejecting portions 600, the set including a shift register SR, a latch circuit LT, a decoder DC, and a transmission gate TG. In the following description, each element of the M set may be referred to as a first stage, a second stage, . . . , and an M-th stage in order from the top in FIG. 5. In the following description, corresponding to the first stage, the second stage, . . . , and the M-th stage, the shift registers SR are respectively referred to as the shift registers SR [1], SR [2], . . . , and SR [M], the latch circuits LT are respectively referred to as the latch circuits LT [1], LT [2], . . . , and LT [M], the decoders DC are respectively referred to as the decoders DC [1], DC [2], . . . , and DC [M], the transmission gates TG are respectively referred to as the transmission gates TG [1], TG [2], . . . , and TG [M], and the drive signals Vin are respectively referred to as the drive signals Vin [1], Vin [2], . . . , and Vin [M], in some cases.

The clock signal SCK, the print data signal SI, the latch signal LAT, the change signal CH, and the drive signal COM are supplied to the selection control circuit 51. Here, although details will be described below, as illustrated in FIG. 5, the drive signal COM according to the present embodiment includes three drive signals Com-A, Com-B, and Com-C.

The print data signal SI is a digital signal which defines the amount of ink to be ejected from the corresponding nozzle 651 when forming one dot of an image. Specifically, the print data signal SI includes 3-bit print data [b1, b2, and b3], and the print data [b1, b2, and b3] defines the amount of ink to be ejected from the nozzle 651. This print data signal SI is input to the selection control circuit 51 as a serial signal synchronized with the clock signal SCK. The selection control circuit 51 generates the drive signal Vin according to the amount of ink to be ejected from the nozzle 651 based on the input print data signal SI. The drive signal Vin output by the selection control circuit 51 is supplied to the corresponding piezoelectric element 60, so that the ink is ejected so as to express four gradations of non-recording, a small dot, a medium dot, and a large dot from the nozzle 651. Further, the selection control circuit 51 generates the inspection drive signal Vin for inspecting a state of the ejecting portion 600 based on the input print data signal SI, and outputs the drive signal Vin to the corresponding ejecting portion 600.

Each of the shift registers SR temporarily holds the print data signal SI for each of 3-bit information corresponding to each of the ejecting portions 600, and sequentially transfers the print data signal SI to the subsequent shift register SR according to the clock signal SCK. Specifically, M shift registers SR respectively corresponding to the M ejecting portions 600 are coupled in series. The print data signal SI supplied serially is sequentially transferred to the shift register SR in the subsequent stage according to the clock signal SCK. At a time when the print data signal SI is transferred to all of the M shift registers SR, the supply of the clock signal SCK is stopped. As a result, print data [b1, b2, and b3] corresponding to each of the M ejecting portions 600 is held in each of the M shift registers SR.

Each of the M latch circuits LT latches the 3-bit print data [b1, b2, and b3] held by each of the M shift registers SR all at once in synchronization with a rising edge of the latch signal LAT. Here, SI [1] to SI [M] illustrated in FIG. 5 are respectively held by the M shift registers SR [1] to SR [M], and indicates the M pieces of print data [b1, b2, and b3] latched by the corresponding latch circuits LT [1] to LT [M].

Here, an operation period during which the liquid ejecting apparatus 1 executes printing includes a plurality of unit operation periods Tu. Further, each unit operation period Tu includes a control period Ts1 and a control period Ts2 following the control period Ts1. The plurality of unit operation periods Tu includes the unit operation period Tu during which a print process is executed, the unit operation period Tu during which an ejection abnormality detection process is executed, the unit operation period Tu during which both the print process and the ejection abnormality detection process are executed, and the like.

The control circuit 100 causes the selection control circuit 51 to supply the print data signal SI to the selection control circuit 51 for each unit operation period Tu, and controls the selection control circuit 51 for the latch circuit LT to latch the print data signal SI for each unit operation period Tu. That is, the control circuit 100 controls the selection control circuit 51 so that the drive signal Vin is supplied to the piezoelectric elements 60 included in the M ejecting portions 600 for each unit operation period Tu.

Specifically, when the liquid ejecting apparatus 1 executes only the print process in the unit operation period Tu, the control circuit 100 controls the selection control circuit 51 to supply the drive signal Vin for printing to the piezoelectric elements 60 included in the M ejecting portions 600. In this case, the amount of ink according to image data input to the liquid ejecting apparatus 1 is ejected from each of the M ejecting portions 600 to the medium P. Therefore, an image corresponding to the image data is formed at the medium P.

On the other hand, when the liquid ejecting apparatus 1 executes only the ejection abnormality detection process in the unit operation period Tu, the control circuit 100 controls the selection control circuit 51 to supply the drive signal Vin for inspection to the piezoelectric elements 60 included in the M ejecting portions 600.

Further, when the liquid ejecting apparatus 1 executes both the print process and the ejection abnormality detection process in the unit operation period Tu, the control circuit 100 controls the selection control circuit 51 to supply the drive signal Vin for printing to some of the piezoelectric elements 60 included in the M ejecting portions 600, and controls the selection control circuit 51 to supply the drive signal Vin for inspection to the piezoelectric elements 60 included in the remaining ejecting portions 600.

The decoder DC decodes the print data [b1, b2, and b3] for 3 bits latched by the latch circuit LT, and outputs selection signals Sa, Sb, and Sc having an H level or an L level in each of the control periods Ts1 and Ts2.

FIG. 6 is a diagram illustrating contents of decoding performed by the decoder DC. As illustrated in FIG. 6, when the print data [b1, b2, and b3] is [1, 0, and 0], the corresponding decoder DC sets the selection signal Sa to the H level and the selection signals Sb and Sc to L level in the control period Ts1, and sets the selection signals Sa and Sc to the L level and the selection signal Sb to the H level in the control period Ts2.

Returning to FIG. 5, the selection control circuit 51 includes the M sets of transmission gates TG. Further, each transmission gate TG includes transmission gates TGa, TGb, and TGc. That is, the selection control circuit 51 is provided with a set of the transmission gates TGa, TGb, and TGc so as to correspond to the M ejecting portions 600.

The selection signal Sa is input to the transmission gate TGa. The transmission gate TGa conducts when the selection signal Sa has the H level, and becomes non-conducting when the selection signal Sa has the L level. In the same manner, the selection signal Sb is input to the transmission gate TGb. The transmission gate TGb conducts when the selection signal Sa has the H level, and becomes non-conducting when the selection signal Sb has the L level. In the same manner, the selection signal Sc is input to the transmission gate TGc. The transmission gate TGc conducts when the selection signal Sa has the H level, and becomes non-conducting when the selection signal Sc has the L level.

For example, when the print data [b1, b2, and b3] is [1, 0, and 0], the transmission gate TGa is controlled to be turned on, and the transmission gates TGb and TGc are controlled to be turned off during the control period Ts1. Further, the transmission gate TGb is controlled to be turned on, and the transmission gates TGa and TGc are controlled to be turned off during the control period Ts2.

Further, as illustrated in FIG. 5, the drive signal Com-A in the drive signal COM is supplied to one end of the transmission gate TGa, the drive signal Com-B in the drive signal COM is supplied to one end of the transmission gate TGb, and the drive signal Com-C in the drive signal COM is supplied to one end of the transmission gate TGc. Each of the other ends of the transmission gates TGa, TGb, and TGc is commonly coupled to an output terminal OTN to the switching circuit 53.

Here, as illustrated in FIG. 6, the selection signals Sa, Sb, and Sc are exclusively at the H level. Therefore, the transmission gates TGa, TGb, and TGc are exclusively turned on in each of the control periods Ts1 and Ts2. As a result, the drive signals Com-A, Com-B, and Com-C exclusively selected for each control period Ts1 and Ts2 are output as drive signals Vin to the output terminal OTN, and are supplied to the corresponding piezoelectric element 60 via the switching circuit 53.

Figure 7:
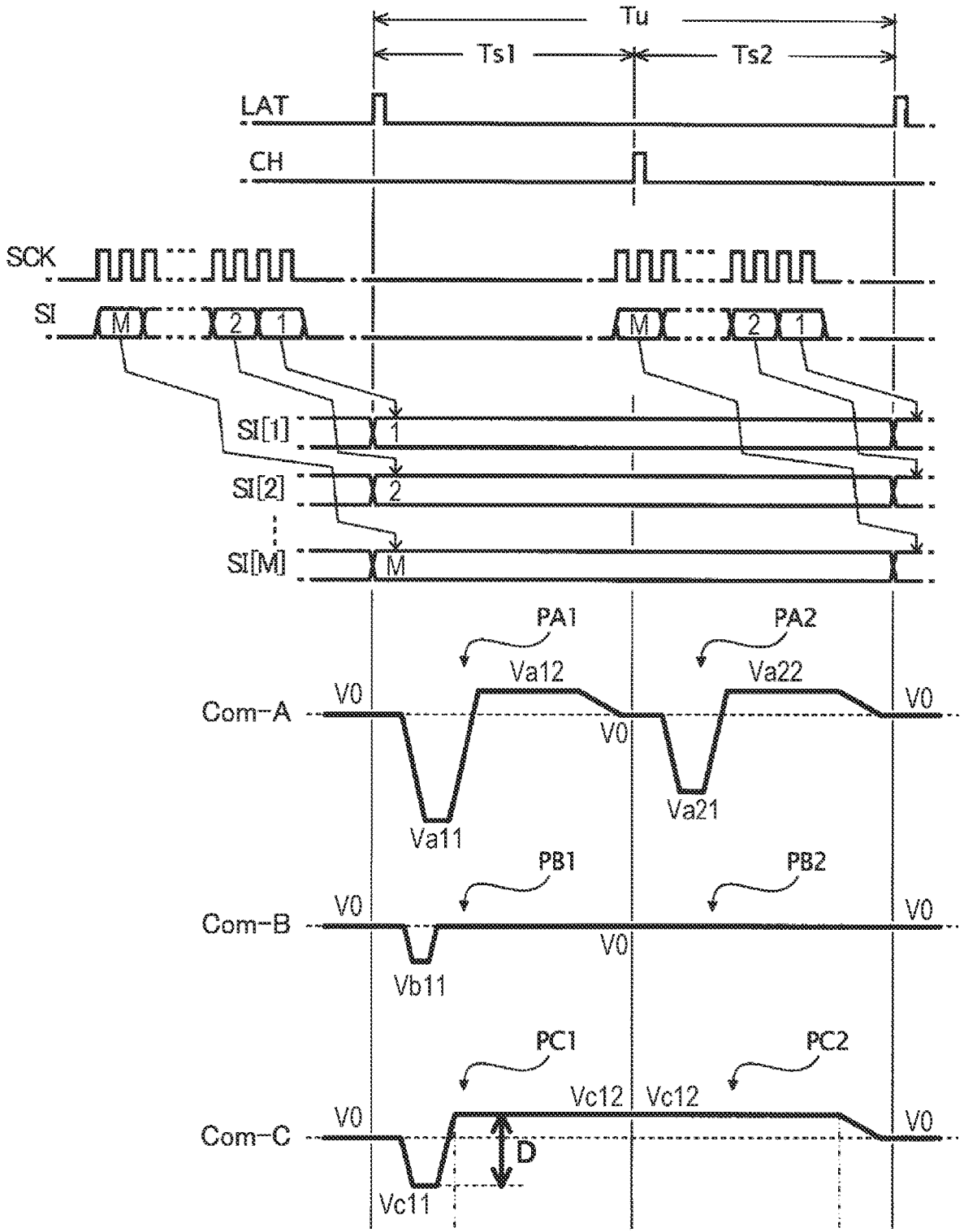
FIG. 7 is a diagram for explaining an operation of the selection control circuit in a unit operation period.

FIG. 7 is a diagram for explaining an operation of the selection control circuit 51 in the unit operation period Tu. As illustrated in FIG. 7, the unit operation period Tu is defined by the latch signal LAT. Further, the control periods Ts1 and Ts2 included in the unit operation period Tu are defined by the latch signal LAT and the change signal CH.

The drive signal Com-A in the drive signal COM supplied from the drive signal output circuit 50*a* is a signal for generating the drive signal Vin for printing in the unit operation period Tu, and includes a waveform in which a unit waveform PA1 arranged in the control period Ts1 and a unit waveform PA2 arranged in the control period Ts2 are continuous. Potentials at the start timing and end timing of the unit waveform PA1 and the unit waveform PA2 are both reference potentials V0. Further, a potential difference between a potential Va11 and a potential Va12 of the unit waveform PA1 is larger than a potential difference between a potential Va21 and a potential Va22 of the unit waveform PA2. Therefore, the amount of ink ejected from the nozzle 651 corresponding to the piezoelectric element 60 when the piezoelectric element 60 is driven by the unit waveform PA1 is more than the amount of ink ejected from the nozzle 651 when the piezoelectric element 60 is driven by the unit waveform PA2. Here, when the piezoelectric element 60 is driven by the unit waveform PA1, the amount of ink ejected from the nozzle 651 corresponding to the piezoelectric element 60 is referred to as a medium amount, and when the piezoelectric element 60 is driven by the unit waveform PA2, the amount of ink ejected from the nozzle 651 corresponding to the piezoelectric element 60 is referred to as a small amount.

Further, the drive signal Com-B in the drive signal COM supplied from the drive signal output circuit 50*a* in the unit operation period Tu is a signal for generating the drive signal Vin for printing, and includes a waveform in which a unit waveform PB1 arranged in the control period Ts1 and a unit waveform PB2 arranged in the control period Ts2 are continuous. Potentials at a start timing and an end timing of the unit waveform PB1 are both the reference potential V0, and a potential of the unit waveform PB2 is maintained at the reference potential V0 over the control period Ts2. Further, a potential difference between a potential Vb11 of the unit waveform PB1 and the reference potential V0 is smaller than a potential difference between the potentials Va21 and the potentials Va22 of the unit waveform PA2. When the piezoelectric element 60 corresponding to the nozzle 651 is driven by the unit waveform PB1, the piezoelectric element 60 is driven to such an extent that the ink is not ejected from the corresponding nozzle 651. Further, when the unit waveform PB2 is supplied to the piezoelectric element 60, the piezoelectric element 60 is not displaced. Therefore, the ink is not ejected from the nozzle 651.

Further, the drive signal Com-C in the drive signal COM supplied from the drive signal output circuit 50*a* in the unit operation period Tu is a signal for generating the drive signal Vin for inspection, and includes a waveform in which a unit waveform PC1 arranged in the control period Ts1 and a unit waveform PC2 arranged in the control period Ts2 are continuous. Potentials at a start timing of the unit waveform PC1 and an end timing of the unit waveform PC2 are both the reference potentials V0. Further, the unit waveform PC1 transitions from the reference potential V0 to a potential Vc11, then transitions from the potential Vc11 to a potential Vc12, and is then maintained at the potential Vc12 until an end of the control period Ts1. Further, after maintaining the potential Vc12, the unit waveform PC2 transitions from the potential Vc12 to the reference potential V0 before an end of the control period Ts2.

As illustrated in FIG. 7, SI [1] to SI [M] supplied as serial signals as print data signal SI are sequentially propagated to the shift register SR by the clock signal SCK. When the clock signal SCK is stopped, SI [1] to SI [M] are held in the corresponding shift registers SR [1] to SR [M]. At a rising timing of the latch signal LAT, that is, a timing at which the unit operation period Tu is started, the M latch circuits LT of the selection control circuit 51 latch SI [1] to SI [M] respectively held in the shift registers SR [1] to SR [M].

In each of the control periods Ts1 and Ts2, each of the M decoders DC outputs the selection signals Sa, Sb, and Sc having logical levels according to SI [1] to SI [M] latched by the latch circuit LT, in accordance with the contents described in FIG. 6.

Each of the M transmission gates TGa, TGb, and TGc is controlled to be conductive or non-conducting based on the logical levels of the input selection signals Sa, Sb, and Sc. As a result, each of the drive signals Com-A, Com-B, and Com-C included in the drive signal COM is selected or deselected so as to generate the drive signal Vin. The generated drive signal Vin is output to the switching circuit 53.

Figure 8:
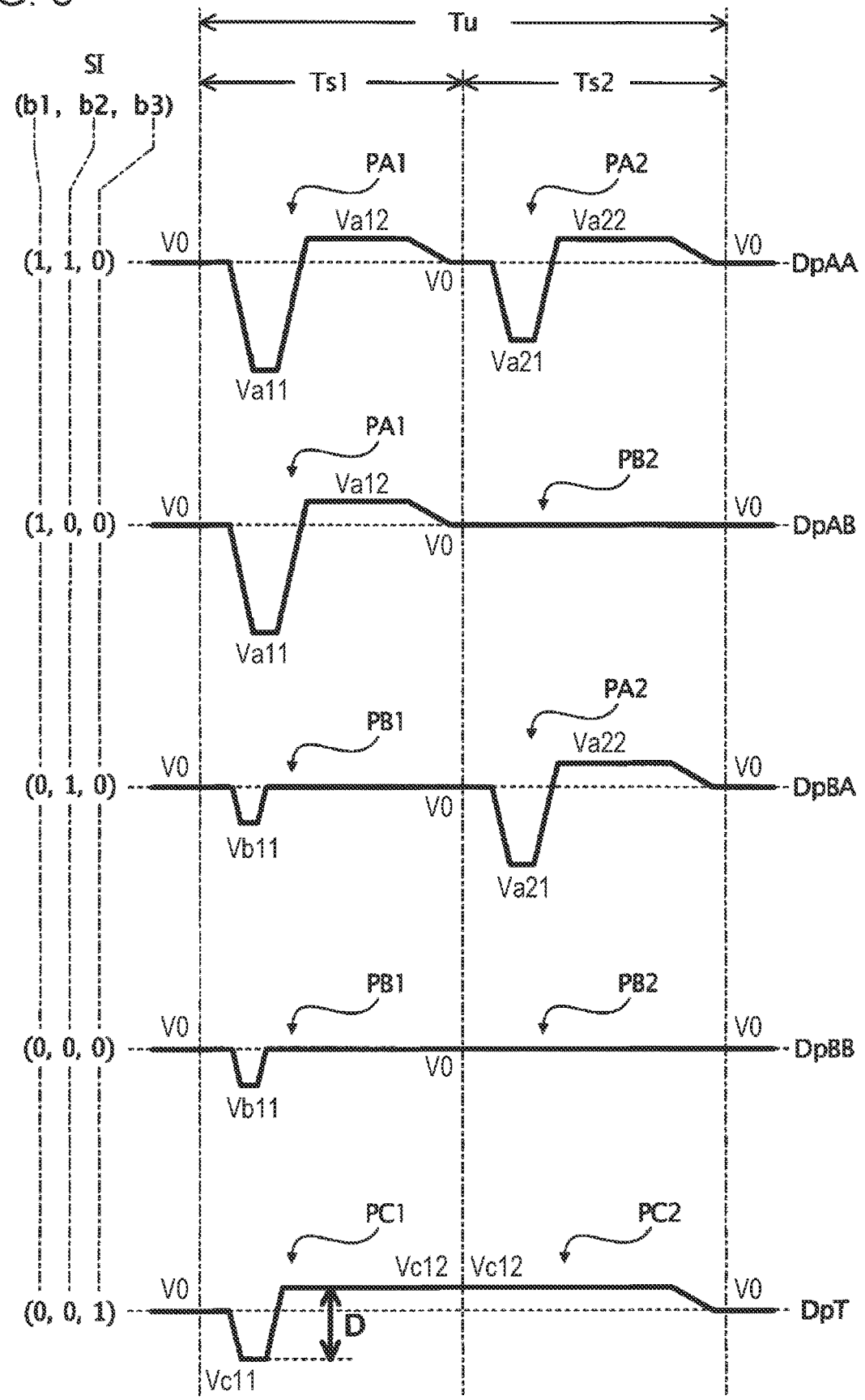
FIG. 8 is a diagram illustrating an example of a waveform of a drive signal.

Next, an example of a waveform of the drive signal Vin output from the selection control circuit 51 in the unit operation period Tu will be described with reference to FIG. 8. FIG. 8 is a diagram illustrating an example of a waveform of the drive signal Vin.

When the print data [b1, b2, and b3] included in the print data signal SI supplied to the selection control circuit 51 in the unit operation period Tu is [1, 1, and 0], the decoder DC sets the logical levels of the selection signals Sa, Sb, and Sc in the control period Ts1 to H, L, and L levels, and sets the logical levels of the selection signals Sa, Sb, and Sc in the control period Ts2 to H, L, and L levels. Therefore, in the control period Ts1, the drive signal Com-A is selected, and in the control period Ts2, the drive signal Com-A is selected. Therefore, the selection control circuit 51 outputs the drive signal Vin having a waveform in which the unit waveform PA1 and the unit waveform PA2 are continuous in the unit operation period Tu. As a result, a medium amount of ink based on the unit waveform PA1 and a small amount of ink based on the unit waveform PA2 are ejected from the corresponding ejecting portion 600 in the unit operation period Tu. The ink ejected from the ejecting portion 600 is combined with the medium P to form a large dot on the medium P.

Further, when the print data [b1, b2, and b3] included in the print data signal SI supplied to the selection control circuit 51 in the unit operation period Tu is [1, 0, and 0], the decoder DC sets the logical levels of the selection signals Sa, Sb, and Sc in the control period Ts1 to H, L, and L levels, and sets the logical levels of the selection signals Sa, Sb, and Sc in the control period Ts2 to L, H, and L levels. Therefore, in the control period Ts1, the drive signal Com-A is selected, and in the control period Ts2, the drive signal Com-B is selected. Therefore, the selection control circuit 51 outputs the drive signal Vin having a waveform in which the unit waveform PA1 and the unit waveform PB2 are continuous in the unit operation period Tu. As a result, a medium amount of ink based on the unit waveform PA1 is ejected from the corresponding ejecting portion 600 in the unit operation period Tu to form a medium dot at the medium P.

Further, when the print data [b1, b2, and b3] included in the print data signal SI supplied to the selection control circuit 51 in the unit operation period Tu is [0, 1, and 0], the decoder DC sets the logical levels of the selection signals Sa, Sb, and Sc in the control period Ts1 to L, H, and L levels, and sets the logical levels of the selection signals Sa, Sb, and Sc in the control period Ts2 to H, L, and L levels. Therefore, in the control period Ts1, the drive signal Com-B is selected, and in the control period Ts2, the drive signal Com-A is selected. Therefore, the selection control circuit 51 outputs the drive signal Vin having a waveform in which the unit waveform PB1 and the unit waveform PA2 are continuous in the unit operation period Tu. As a result, a small amount of ink based on the unit waveform PA2 is ejected from the corresponding ejecting portion 600 in the unit operation period Tu to form a small dot at the medium P.

Further, when the print data [b1, b2, and b3] included in the print data signal SI supplied to the selection control circuit 51 in the unit operation period Tu is [0, 0, and 0], the decoder DC sets the logical levels of the selection signals Sa, Sb, and Sc in the control period Ts1 to L, H, and L levels, and sets the logical levels of the selection signals Sa, Sb, and Sc in the control period Ts2 to L, H, and L levels. Therefore, in the control period Ts1, the drive signal Com-B is selected, and in the control period Ts2, the drive signal Com-B is selected. Therefore, the selection control circuit 51 outputs the drive signal Vin having a waveform in which the unit waveform PB1 and the unit waveform PB2 are continuous in the unit operation period Tu. As a result, the ink is not ejected from the corresponding ejecting portion 600 in the unit operation period Tu. Therefore, the dot is not formed at the medium P. In this case, by driving the piezoelectric element 60 to such an extent that the ink is not ejected from the ejecting portion 600, the drive signal Vin output by the selection control circuit 51 corresponds to a so-called micro-vibration waveform which reduces a possibility that the ink in the vicinity of the nozzle 651 is thickened.

Further, when the print data [b1, b2, and b3] included in the print data signal SI supplied to the selection control circuit 51 in the unit operation period Tu is [0, 0, and 1], the decoder DC sets the logical levels of the selection signals Sa, Sb, and Sc in the control period Ts1 to L, L, and H levels, and sets the logical levels of the selection signals Sa, Sb, and Sc in the control period Ts2 to L, L, and H levels. Therefore, in the control period Ts1, the drive signal Com-C is selected, and in the control period Ts2, the drive signal Com-C is selected. Therefore, the selection control circuit 51 outputs the drive signal Vin having a waveform in which the unit waveform PC1 and the unit waveform PC2 are continuous in the unit operation period Tu. As a result, the ink is not ejected from the corresponding ejecting portion 600 in the unit operation period Tu. Therefore, the dot is not formed at the medium P. In this case, the drive signal Vin output by the selection control circuit 51 corresponds to an inspection waveform for detecting residual vibration of the piezoelectric element 60.

Figure 9:
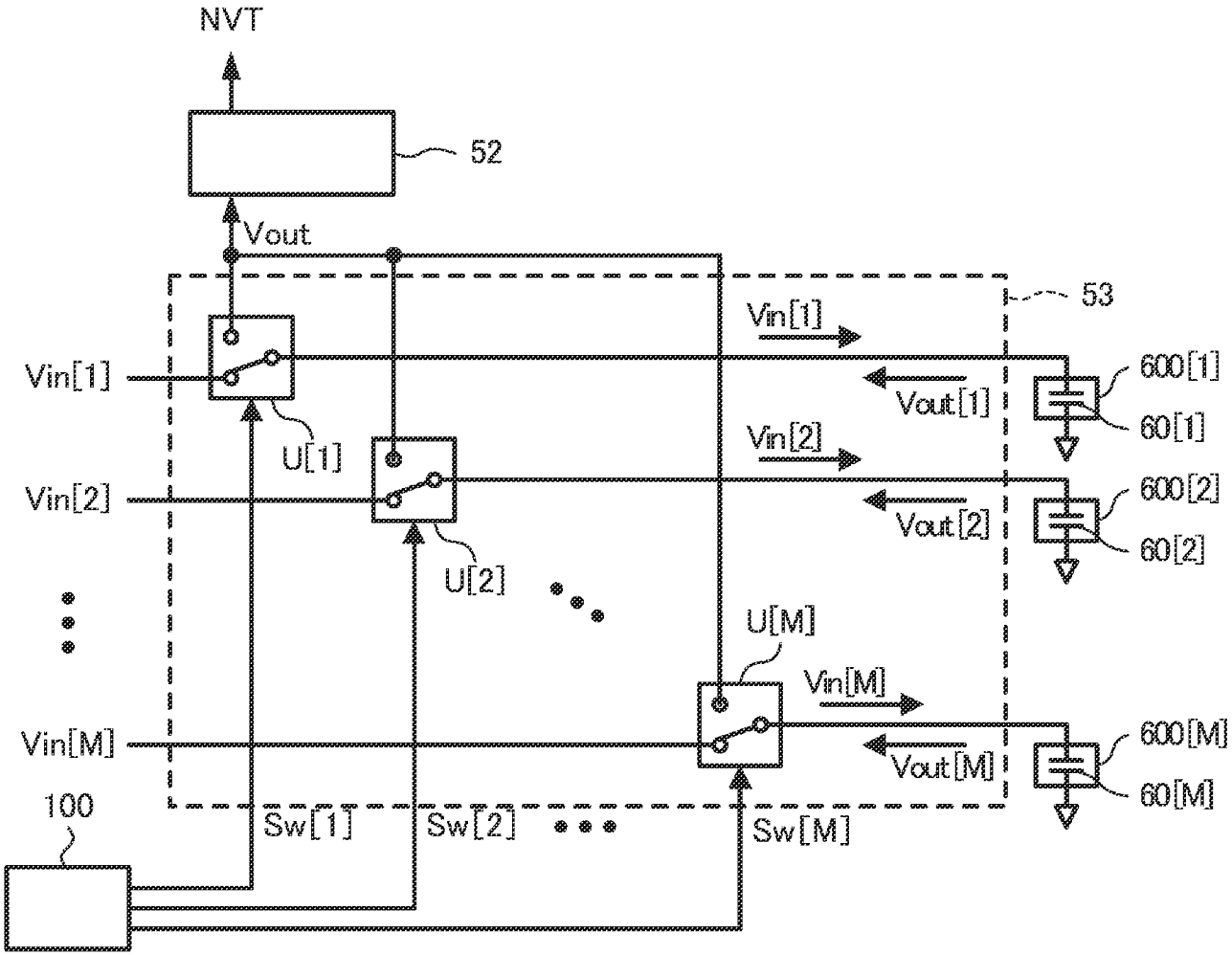
FIG. 9 is a diagram illustrating an electrical configuration of a switching circuit and a residual signal detection circuit.

Next, a specific example of a configuration and an operation of the switching circuit 53 and the residual vibration detection circuit 52 will be described. FIG. 9 is a diagram illustrating an electrical configuration of the switching circuit 53 and the residual vibration detection circuit 52. In the following description, changeover switches U respectively corresponding to a first stage, a second stage, . . . , and an M-th stage are referred to as changeover switches U [1], U [2], . . . , and U [M], the ejecting portions 600 are referred to as the ejecting portions 600 [1], 600 [2], . . . , and 600 [M], the piezoelectric elements 60 are referred to as the piezoelectric elements 60 [1], 60 [2], . . . , and 60 [M], and the switching control signals Sw are referred to as the switching control signals Sw [1], Sw [2], . . . , and Sw [M], and the residual vibrations Vout are referred to as the residual vibrations Vout [1], Vout [2], . . . , and Vout [M].

As illustrated in FIG. 9, the switching circuit 53 includes the M changeover switches U corresponding to the M piezoelectric elements 60 included in the respective M ejecting portions 600. Each changeover switch U switches whether or not to supply the drive signal Vin input from the selection control circuit 51 to the piezoelectric element 60 included in the corresponding ejecting portion 600 based on the switching control signal Sw, or to supply the residual vibration Vout generated in the ejecting portion 600 after the drive signal Vin is supplied to the piezoelectric element 60, to the residual vibration detection circuit 52.

Specifically, the switching control signal Sw [1] is input to the changeover switch U [1]. The changeover switch U [1] switches whether or not to supply the drive signal Vin [1] to the piezoelectric element 60 [1] based on the switching control signal Sw [1], or to supply the residual vibration Vout [1] generated in the ejecting portion 600 [1] after the drive signal Vin [1] is supplied to the piezoelectric element 60 [1], to the residual vibration detection circuit 52.

In the same manner, the switching control signal Sw [M] is input to the changeover switch U [M]. The changeover switch U [M] switches whether or not to supply the drive signal Vin [M] to the piezoelectric element 60 [M] based on the switching control signal Sw [M], or to supply the residual vibration Vout [i] generated in the ejecting portion 600 [*i*] after the drive signal Vin [M] is supplied to the piezoelectric element 60 [M], to the residual vibration detection circuit 52.

Here, the switching control signals Sw [1] to Sw [M] control the switching of the M changeover switches U [1] to U [M] so that any one of the M piezoelectric elements 60 [1] to 60 [M] is electrically coupled to the residual vibration detection circuit 52 in the unit operation period Tu. In other words, the residual vibration detection circuit 52 detects any one of the residual vibrations Vout [1] to Vout [M] respectively corresponding to the M ejecting portions 600 [1] to 600 [M] based on the switching control signal Sw, and generates the corresponding residual vibration signal NVT. Therefore, the switching control signal Sw may control the M changeover switches U [1] to U [M] to be sequentially turned on, and the switching control signal Sw output from the control circuit 100 may be propagated by the shift register or the like to sequentially switch the M changeover switches U, for example.

Figure 10:
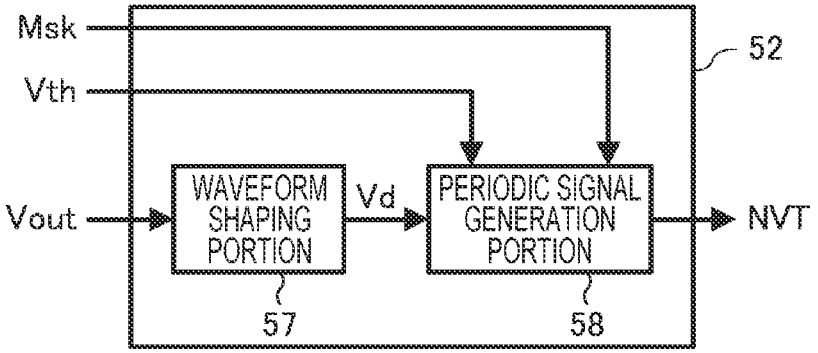
FIG. 10 is a diagram illustrating an electrical configuration of a residual vibration detection circuit.

Next, a configuration of the residual vibration detection circuit 52 will be described. FIG. 10 is a diagram illustrating an electrical configuration of the residual vibration detection circuit 52. The residual vibration detection circuit 52 detects the residual vibration Vout, generates the residual vibration signal NVT indicating at least one of a period and a vibration frequency of the detected residual vibration Vout, and outputs the residual vibration signal NVT to the control circuit 100.

As illustrated in FIG. 10, the residual vibration detection circuit 52 includes a waveform shaping portion 57 and a periodic signal generation portion 58. The waveform shaping portion 57 generates a shaped waveform signal Vd in which a noise component is removed from the residual vibration Vout. The waveform shaping portion 57 includes, for example, a high-pass filter for outputting a signal in which a frequency component in a frequency lower than a frequency bandwidth of the residual vibration Vout is attenuated, a low-pass filter for outputting a signal in which a frequency component in a frequency higher than the frequency bandwidth of the residual vibration Vout, and the like. The waveform shaping portion 57 limits a frequency range of the residual vibration Vout and outputs the shaped waveform signal Vd from which the noise component is removed. Further, the waveform shaping portion 57 may include a negative feedback type amplifier circuit for adjusting an amplitude of the residual vibration Vout, a voltage follower circuit for converting an impedance of the residual vibration Vout, and the like.

The periodic signal generation portion 58 generates the residual vibration signal NVT indicating the period and the vibration frequency of the residual vibration Vout based on the shaped waveform signal Vd, and outputs the residual vibration signal NVT to the control circuit 100. The shaped waveform signal Vd, a mask signal Msk, and a threshold potential Vth are input to the periodic signal generation portion 58. Here, the mask signal Msk and the threshold potential Vth may be, for example, stored in the control circuit 100, or may be information stored in a storage portion (not illustrated).

Figure 11:
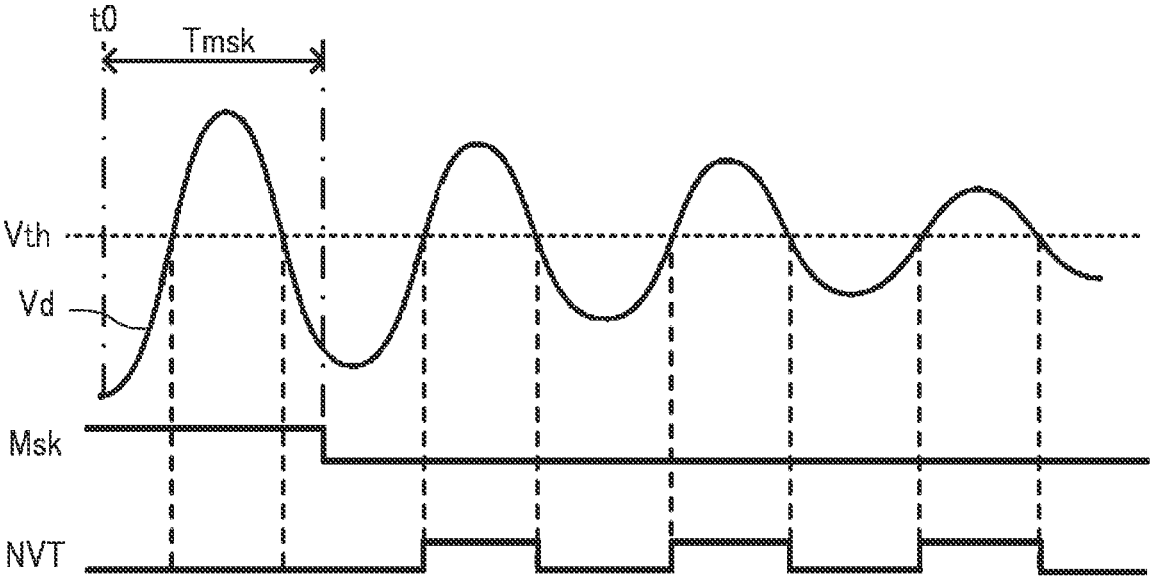
FIG. 11 is a diagram for explaining an operation of a periodic signal generation portion.

FIG. 11 is a diagram for explaining an operation of the periodic signal generation portion 58. As illustrated in FIG. 11, the threshold potential Vth is a threshold value defined at a potential having a predetermined level within an amplitude of the shaped waveform signal Vd, and is defined, for example, at a potential having a center level of the amplitude of the shaped waveform signal Vd. The periodic signal generation portion 58 generates and outputs the residual vibration signal NVT based on the input shaped waveform signal Vd and threshold potential Vth.

Specifically, the periodic signal generation portion 58 compares the potential of the shaped waveform signal Vd with the threshold potential Vth. The periodic signal generation portion 58 generates the residual vibration signal NVT having the H level when the potential of the shaped waveform signal Vd is equal to or higher than the threshold potential Vth, and having the L level when the potential of the shaped waveform signal Vd is less than the threshold potential Vth. That is, a period since a logical level of the residual vibration signal NVT transitions from the H level to the L level until the logical level reaches the H level again corresponds to a period of the residual vibration Vout, and a reciprocal of the period corresponds to the vibration frequency.

The mask signal Msk is a signal which becomes the H level only during a predetermined period Tmsk from a time t0 when the supply of the shaped waveform signal Vd is started. The periodic signal generation portion 58 stops the generation of the residual vibration signal NVT during a period when the mask signal Msk is in the L level, and generates the residual vibration signal NVT during a period when the mask signal Msk is H level. That is, the periodic signal generation portion 58 generates the residual vibration signal NVT with only the shaped waveform signal Vd after the lapse of the period Tmsk among the shaped waveform signals Vd, as a target. As a result, the periodic signal generation portion 58 can exclude the noise component superimposed immediately after the residual vibration Vout is generated, and can generate the highly accurate residual vibration signal NVT.

As described above, the drive signal selection control circuit 200 switches whether or not to supply the waveform included in the drive signal COM to the plurality of piezoelectric elements 60 included in the plurality of ejecting portions 600, based on the clock signal SCK, the print data signal SI, the latch signal LAT, and the change signal CH. That is, the drive signal selection control circuit 200 generates the drive signal Vin to be supplied to the plurality of piezoelectric elements 60 included in the plurality of ejecting portions 600, and supplies the drive signal Vin to the piezoelectric elements 60 included in the corresponding ejecting portions 600.

4. Integrated Circuit Configuration

Here, as described above, the drive signal selection control circuit 200 is mounted at the integrated circuit 201. In addition to the selection control circuit 51, the residual vibration detection circuit 52, and the switching circuit 53 included in the drive signal selection control circuit 200 described above, various circuits such as a power-on reset circuit (not illustrated) for resetting the inside of the integrated circuit 201 when a power supply voltage is supplied to the integrated circuit 201, a temperature measurement circuit which measures an internal temperature of the integrated circuit 201, and an internal voltage generation circuit which outputs an internal voltage used in the integrated circuit 201 are mounted at the integrated circuit 201.

Further, in response to the recent market demand for productivity improvement in the liquid ejecting apparatus 1, the number of nozzles provided in the print head 21 is increased, and the amount of ink ejected from one nozzle 651 is increased. As a result, the amount of current supplied to the integrated circuit 201 is increased. As the amount of current supplied to the integrated circuit 201 increases, a noise component generated in the integrated circuit 201 increases, and as a result, the integrated circuit 201 may malfunction due to the noise component.

In particular, the drive signal selection control circuit 200 controls switching whether or not to supply the drive signal COM to the plurality of ejecting portions 600 included in the print head 21. Therefore, when the number of ejecting portions 600 included in the print head 21 increases, a large current flows through the drive signal selection control circuit 200 as the number of ejecting portions 600 increases. Further, since the drive signal selection control circuit 200 controls switching whether or not to supply the drive signal COM, a switching noise due to the switching occurs. That is, in order to reduce the influence of the noise component which increases with the increase in the amount of current supplied to the integrated circuit 201, it is required to appropriately arrange the drive signal selection control circuit 200 mounted at the integrated circuit 201.

In the liquid ejecting apparatus 1, the print head 21, and the integrated circuit 201 according to the present embodiment, in view of the above problems, by appropriately arranging the drive signal selection control circuit 200, inside the integrated circuit 201 which controls the drive of the piezoelectric element 60 as a capacitive load of the print head 21 used in the liquid ejecting apparatus 1, the influence of the noise component increasing with the increase in the amount of current on the integrated circuit 201 is reduced, and a possibility that the integrated circuit 201 malfunctions is reduced.

Figure 12:
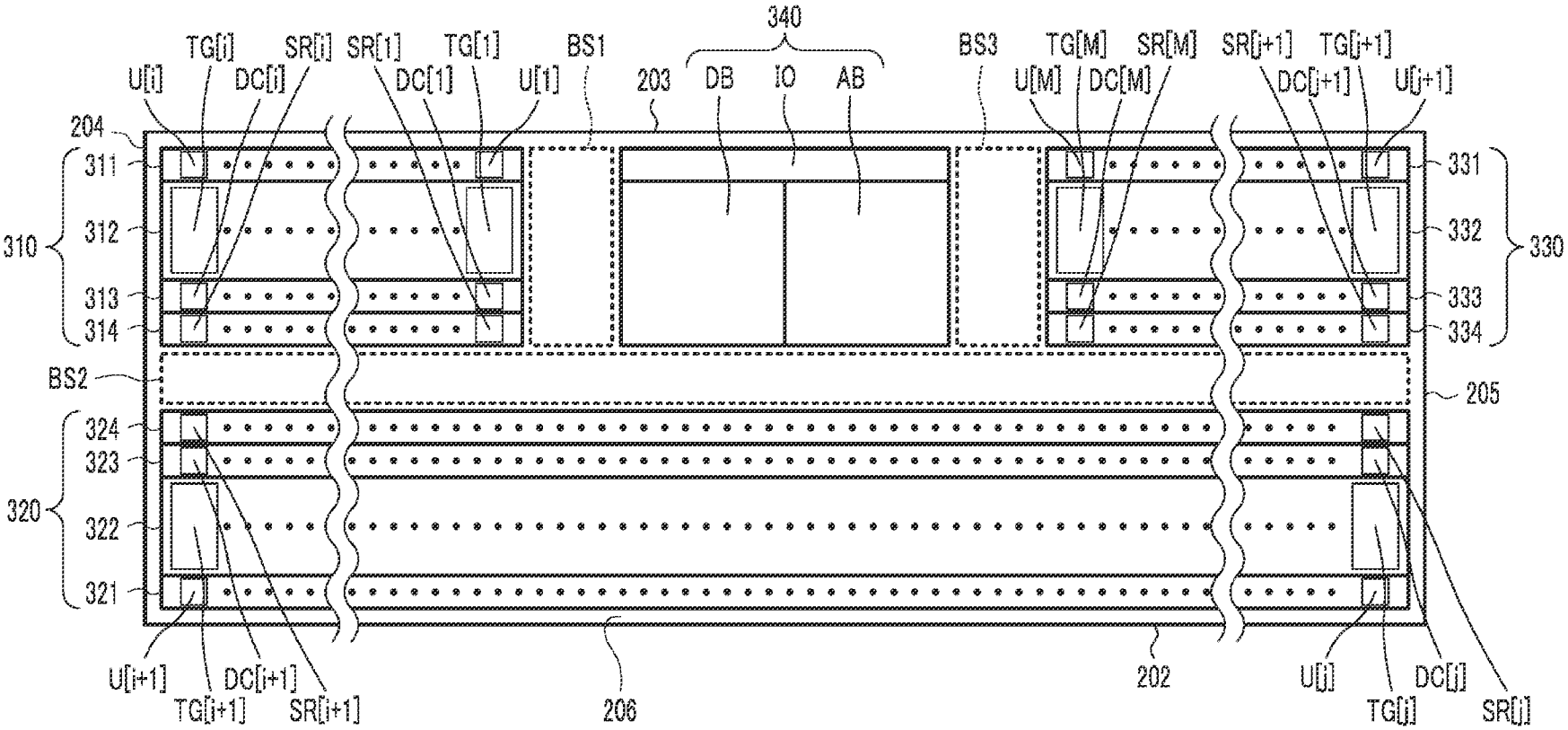
FIG. 12 is a diagram illustrating an example of arrangement of internal circuits in an integrated circuit.
Figure 13:
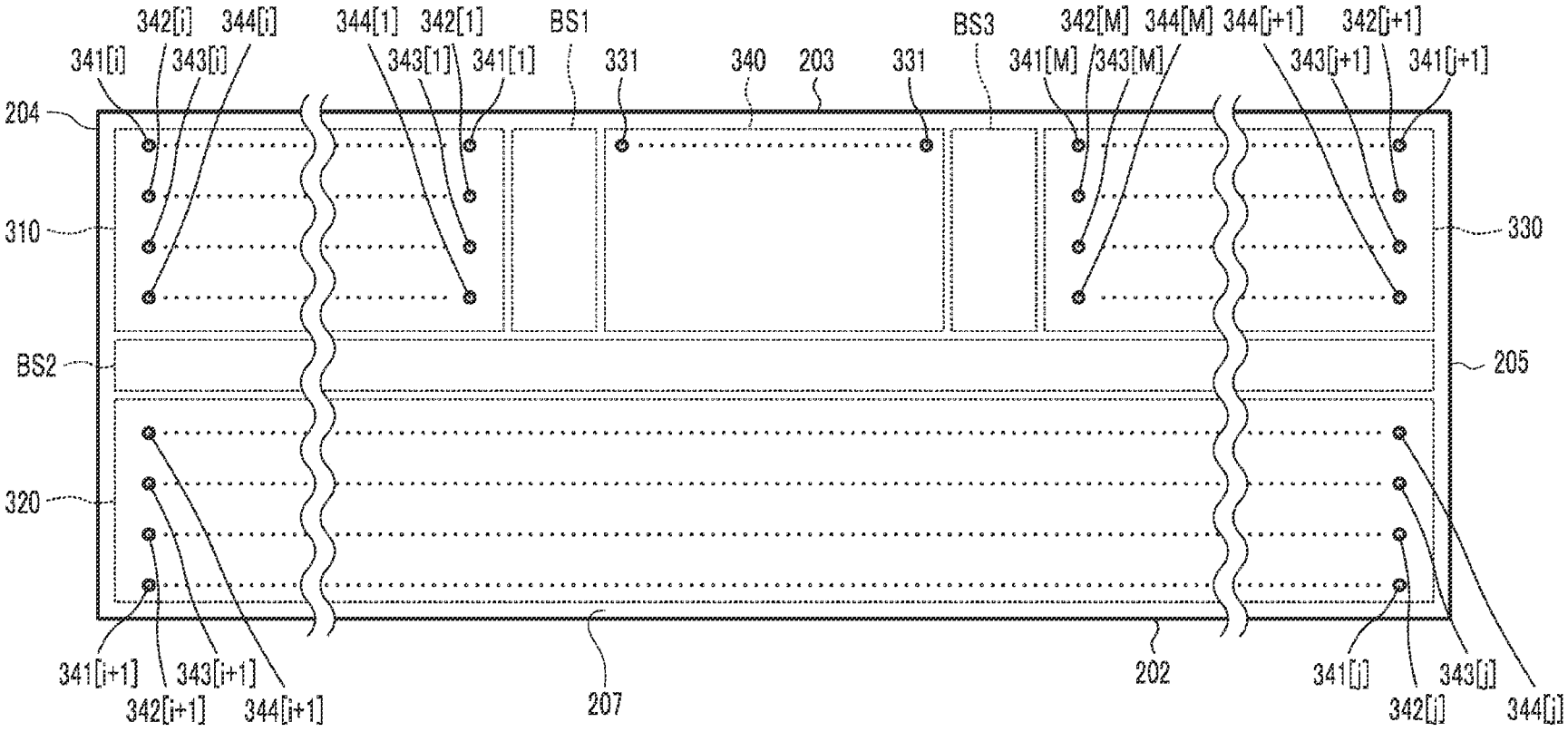
FIG. 13 is a diagram illustrating an example of arrangement of terminals of the integrated circuit.

FIG. 12 is a diagram illustrating an example of arrangement of internal circuits in the integrated circuit 201. FIG. 13 is a diagram illustrating an example of terminal arrangement of the integrated circuit 201 in which the integrated circuit 201 and the FPC 210 are electrically coupled with each other. Here, FIGS. 12 and 13 are illustrated when the integrated circuit 201 is viewed from the same surface. Specifically, FIG. 12 illustrates a circuit mounting surface 206 when the inside of the integrated circuit 201 is viewed from the drive signal selection control circuit 200 and the circuit mounting surface 206 at which the various circuits included in the integrated circuit 201 are mounted, and FIG. 13 illustrates a terminal mounting surface 207 which electrically couples the integrated circuit 201 and the FPC 210 when the inside of the integrated circuit 201 is viewed from the circuit mounting surface 206 side. Further, in FIG. 13, circuit blocks 310, 320, 330, and 340 indicating arrangement of various circuits mounted at the circuit mounting surface 206 of the integrated circuit 201 are illustrated by broken lines.

As illustrated in FIGS. 12 and 13, the integrated circuit 201 has a substantially rectangular shape including a side 202, a side 203 located facing the side 202, a side 204 intersecting both the side 202 and the side 203, and a side 205 intersecting both the side 202 and the side 203 and located facing the side 204, and includes the circuit mounting surface 206 at which various circuits included in the integrated circuit 201 are mounted, and the terminal mounting surface 207 at which a plurality of terminals electrically coupled to the FPC 210 are provided. Here, the side 202 is an example of a first side, the side 203 is an example of a second side, the side 204 is an example of a third side, and the side 205 is an example of a fourth side.

As illustrated in FIG. 12, four circuit blocks 310, 320, 330, and 340 are provided at the circuit mounting surface 206 of the integrated circuit 201. The circuit block 310 is located on the side 203 side and the side 204 side of the integrated circuit 201, the circuit block 320 is located on the side 202 side of the integrated circuit 201, the circuit block 330 is located on the side 203 side and the side 205 side of the integrated circuit 201, and the circuit block 340 is located between the circuit block 310 and the circuit block 330 on the side 203 side of the integrated circuit 201 in a direction from the side 204 to the side 205. That is, the circuit block 320 is located along the side 202, and the circuit blocks 310, 330, and 340 are located side by side in order of the circuit block 310, the circuit block 340, and the circuit block 330 from the side 204 toward the side 205 along the side 203. Here, the circuit block 320 is an example of a first circuit block, the circuit block 310 is an example of a second circuit block, the circuit block 330 is an example of a third circuit block, and the circuit block 340 is an example of a fourth circuit block.

Specific configurations of the circuit blocks 310, 320, 330, and 340 will be described.

As illustrated in FIG. 12, the circuit block 310 includes circuit mounting areas 311, 312, 313, 314. The circuit mounting area 311 is located along the side 203 in the circuit block 310. In the circuit mounting area 311, the changeover switches U [1] to U [i] corresponding to the ejecting portions 600 [1] to 600 [*i*] (i=1 to M−2) among the M ejecting portions 600 [1] to 600 [M] are located side by side in order of the changeover switches U [1], U [2], . . . , and U [i] along the side 203 from the side 205 toward the side 204.

The circuit mounting area 312 is located along the side 203 on the side 202 side of the circuit mounting area 311, in the circuit block 310. In the circuit mounting area 312, the transmission gates TG [1] to TG [i] corresponding to the ejecting portions 600 [1] to 600 [*i*] among the M ejecting portions 600 [1] to 600 [M] are located side by side in order of transmission gate TG [1], TG [2], . . . , and TG [i] along the side 203 from the side 205 toward the side 204.

The circuit mounting area 313 is located along the side 203 on the side 202 side of the circuit mounting area 312, in the circuit block 310. In the circuit mounting area 313, the decoders DC [1] to DC [i] corresponding to the ejecting portions 600 [1] to 600 [*i*] among the M ejecting portions 600 [1] to 600 [M] are located side by side in order of the decoders DC [1], DC [2], . . . , and DC [i] along the side 203 from the side 205 toward the side 204.

The circuit mounting area 314 is located along the side 203 on the side 202 side of the circuit mounting area 313, in the circuit block 310. In the circuit mounting area 314, the shift registers SR [1] to SR [i] corresponding to the ejecting portions 600 [1] to 600 [*i*] among the M ejecting portions 600 [1] to 600 [M] are located side by side in order of the shift registers SR [1], SR [2], . . . , and SR [i] along the side 203 from the side 205 toward the side 204.

As described above, the circuit block 310 includes the transmission gates TG [1] to TG [i] which switches whether or not to supply the drive signals Vin [1] to Vin [i] based on the drive signal COM to the piezoelectric elements 60 [1] to 60 [*i*] included in the ejecting portions 600 [1] to 600 [*i*], and the decoders DC [1] to DC [i] and shift registers SR [1] to SR [i] which control the switching of the transmission gates TG [1] to TG [i], and the transmission gates TG [1] to TG [i] are located so that the shortest distance between the transmission gates TG [1] to TG [i] and the side 203 is smaller than the shortest distance between the decoder DC [1] to DC [i] and the shift registers SR [1] to SR [i], and the side 203.

Further, as illustrated in FIG. 13, in the integrated circuit 201, terminals 341 [1] to 341 [*i*], terminals 342 [1] to 342 [*i*], terminals 343 [1] to 343 [*i*], and terminals 344 [1] to 344 [*i*] are located at the terminal mounting surface 207 corresponding to an area in which the circuit block 310 of the terminal mounting surface 207 is located.

Each of the terminals 341 [1] to 341 [*i*] is electrically coupled to each of the changeover switches U [1] to U [i] and each of the piezoelectric elements 60 [1] to 60 [*i*] included in the ejecting portions 600 [1] to 600 [i]. That is, the terminal 341 [1] outputs the drive signal Vin [1] to be supplied to the piezoelectric element 60 [1] from the integrated circuit 201, and inputs the residual vibration Vout [1] to the integrated circuit 201. In the same manner, the terminal 341 [*i*] outputs the drive signal Vin [i] to be supplied to the piezoelectric element 60 [*i*] from the integrated circuit 201, and inputs the residual vibration Vout [i] to the integrated circuit 201. The respective terminals 341 [1] to 341 [*i*] are located side by side in order of the terminals 341 [1], 341 [2], . . . , and 341 [*i*] in a direction from the side 205 to the side 204 along the side 203.

Each of the terminals 342 [1] to 342 [*i*] is electrically coupled to the transmission gate TGa included in each of the transmission gates TG [1] to TG [i]. The drive signal Com-A is supplied to the transmission gate TGa via each of the terminals 342 [1] to 342 [*i*]. The respective terminals 342 [1] to 342 [*i*] are located on the side 202 side of the terminals 341 [1] to 341 [*i*] provided side by side along the side 203, and are located side by side in order of the terminals 342 [1], 342 [2], . . . , and 342 [*i*] in the direction from the side 205 to the side 204.

Each of the terminals 343 [1] to 343 [*i*] is electrically coupled to the transmission gate TGb included in each of the transmission gates TG [1] to TG [i]. The drive signal Com-B is supplied to the transmission gate TGb via each of the terminals 343 [1] to 343 [*i*]. The respective terminals 343 [1] to 343 [*i*] are located on the side 202 side of the terminals 342 [1] to 342 [*i*] provided side by side along the side 203, and are located side by side in order of the terminals 343 [1], 343 [2], . . . , and 343 [*i*] in the direction from the side 205 to the side 204.

Each of the terminals 344 [1] to 344 [*i*] is electrically coupled to the transmission gate TGc included in each of the transmission gates TG [1] to TG [i]. The drive signal Com-C is supplied to the transmission gate TGc via each of the terminals 344 [1] to 344 [*i*]. The respective terminals 344 [1] to 344 [*i*] are located on the side 202 side of the terminals 343 [1] to 343 [*i*] provided side by side along the side 203, and are located side by side in order of the terminals 343 [1], 343 [2], . . . , and 343 [*i*] in the direction from the side 205 to the side 204.

Here, any one of the piezoelectric elements 60 [1] to 60 [*i*] included in the ejecting portions 600 [1] to 600 [*i*] is an example of a second piezoelectric element and a second capacitive load, and the piezoelectric element. 60 [1] to 60 [*i*] are an example of a second piezoelectric element group and a second capacitive load group. The terminals 341 [1] to 341 [1] located along the side 203 and electrically coupled to the piezoelectric elements 60 [1] to 60 [*i*] among the plurality of piezoelectric elements 60 are an example of a second terminal group.

As illustrated in FIG. 12, the circuit block 320 includes circuit mounting areas 321, 322, 323, and 324. The circuit mounting area 321 is located along the side 202 at the circuit block 320. In the circuit mounting area 321, the changeover switches U [i+1] to U [j] corresponding to the ejecting portions 600 [*i*+1] to 600 [*j*] (j=i+1 to M−1) among the M ejecting portions 600 [1] to 600 [M] are located side by side from side 204 toward side 205 along the side 202 in order of the changeover switches U [i+1], U [i+2], . . . , and U [j].

The circuit mounting area 322 is located along the side 202 on the side 203 side of the circuit mounting area 321, in the circuit block 320. In the circuit mounting area 322, the transmission gates TG [i+1] to TG [j] corresponding to the ejecting portions 600 [*i*+1] to 600 [j] among the M ejecting portions 600 [1] to 600 [M] are located side by side in order of the transmission gates TG [i+1], TG [i+2], . . . , and TG [j] along the side 202 from the side 204 toward the side 205.

The circuit mounting area 323 is located along the side 202 on the side 203 side of the circuit mounting area 322, in the circuit block 320. In the circuit mounting area 323, the decoders DC [i+1] to DC [j] corresponding to the ejecting portions 600 [*i*+1] to 600 [*j*] among the M ejecting portions 600 [1] to 600 [M] are located side by side in order of the decoders DC [i+1], DC [i+2], . . . , and DC [j] along the side 202 from the side 204 toward the side 205.

The circuit mounting area 324 is located along the side 202 on the side 203 side of the circuit mounting area 323, in the circuit block 320. In the circuit mounting area 324, the shift registers SR [i+1] to SR [j] corresponding to the ejecting portions 600 [*i*+1] to 600 [*j*] among the M ejecting portions 600 [1] to 600 [M] are located side by side in order of the shift registers SR [i+1], SR [i+2], . . . , and SR [j] along the side 202 from the side 204 toward the side 205.

As described above, the circuit block 320 includes the transmission gates TG [i+1] to TG [j] which switches whether or not to supply the drive signals Vin [i+1] to Vin [j] based on the drive signal COM to the piezoelectric elements 60 [*i*+1] to 60 [*j*] included in the ejecting portions 600 [*i*+1] to 600 [*j*], and the decoders DC [i+1] to DC [j] and the shift registers SR [i+1] to SR [j] which control the switching of the transmission gates TG [i+1] to TG [j], and the transmission gates TG [i+1] to TG [j] are located so that the shortest distance between the transmission gates TG [i+1] to TG [j] and the side 202 is smaller than the shortest distance between the decoders DC [i+1] to DC [j] and the shift registers SR [i+1] to SR [j], and the side 203. Here, any one of the transmission gates TG [i+1] to TG [j] is an example of a switch circuit, and any one of the corresponding decoders DC [i+1] to DC [j] and the shift registers SR [i+1] to SR [j] is an example of a switching control circuit.

Further, as illustrated in FIG. 13, in the integrated circuit 201, the terminals 341 [*i*+1] to 341 [*j*], the terminals 342 [*i*+1] to 342 [*j*], the terminals 343 [*i*+1] to 343 [*j*], and the terminals 344 [*i*+1] to 344 [*j*] are located at the terminal mounting surface 207 corresponding to an area in which the circuit block 320 of the terminal mounting surface 207 is located.

Each of the terminals 341 [*i*+1] to 341 [*j*] is electrically coupled to each of the changeover switches U [i+1] to U [j] and the piezoelectric elements 60 [*i*+1] to 60 [*j*] included in and the ejecting portions 600 [*i*+1] to 600 [*j*]. That is, the terminal 341 [*i*+1] outputs the drive signal Vin [i+1] to be supplied to the piezoelectric element 60 [*i*+1] from the integrated circuit 201, and inputs the residual vibration Vout [i+1] to the integrated circuit 201. In the same manner, the terminal 341 [*j*] outputs the drive signal Vin [j] to be supplied to the piezoelectric element 60 [*j*] from the integrated circuit 201, and inputs the residual vibration Vout [j] to the integrated circuit 201. The respective terminals 341 [*i*+1] to 341 [j] are located side by side in order of the terminals 341 [i+1], 341 [*i*+2], . . . , and 341 [*j*] in a direction from the side 204 to the side 205 along the side 202.

Each of the terminals 342 [*i*+1] to 342 [j] is electrically coupled to the transmission gate TGa included in each of the transmission gates TG [i+1] to TG [j]. The drive signal Com-B is supplied to the transmission gate TGa via each of the terminals 342 [*i*+1] to 342 [*j*]. The respective terminals 342 [*i*+1] to 342 [*j*] are located on the side 203 side of the terminals 341 [*i*+1] to 341 [*j*] provided side by side along the side 202, and are located side by side in order of the terminals 342 [*i*+1], 342 [*i*+2], . . . , and 342 [*j*] in a direction from the side 204 to the side 205.

Each of the terminals 343 [*i*+1] to 343 [*j*] is electrically coupled to the transmission gate TGb included in each of the transmission gates TG [i+1] to TG [j]. The drive signal Com-B is supplied to the transmission gate TGb via each of the terminals 343 [*i*+1] to 343 [*j*]. The respective terminals 343 [*i*+1] to 343 [*j*] are located on the side 203 side of the terminals 342 [*i*+1] to 342 [*j*] provided side by side along the side 202, and are located side by side in order of the terminals 343 [*i*+1], 343 [*i*+2], . . . , and 343 [*j*] in a direction from the side 204 to the side 205.

Each of the terminals 344 [*i*+1] to 344 [*j*] is electrically coupled to the transmission gate TGc included in each of the transmission gates TG [i+1] to TG [j]. The drive signal Com-C is supplied to the transmission gate TGc via each of the terminals 344 [*i*+1] to 344 [*j*]. The respective terminals 344 [*i*+1] to 344 [*j*] are located on the side 203 side of the terminals 343 [*i*+1] to 343 [*j*] provided side by side along the side 202, and are located side by side in order of the terminals 344 [*i*+1], 344 [*i*+2], . . . , and 344 [*j*] in a direction from the side 204 to the side 205.

Here, any one of the piezoelectric elements 60 [*i*+1] to 60 [*j*] included in the ejecting portions 600 [*i*+1] to 600 [*j*] is an example of a first piezoelectric element and a first capacitive load, and the piezoelectric element. 60 [*i*+1] to 60 [*j*] are an example of a first piezoelectric element group and a first capacitive load group. The terminals 341 [*i*+1] to 341 [*j*] located along the side 202 and electrically coupled to the piezoelectric elements 60 [*i*+1] to 60 [*j*] among the plurality of piezoelectric elements 60 are an example of a first terminal group.

As illustrated in FIG. 12, the circuit block 330 includes circuit mounting areas 331, 332, 333, and 334. The circuit mounting area 331 is located along the side 203 at the circuit block 330. In the circuit mounting area 331, the changeover switches U [j+1] to U [M] corresponding to the ejecting portions 600 [*j*+1] to 600 [M] among the M ejecting portions 600 [1] to 600 [M] are located side by side in order of the changeover switches U [j+1], U [j+2], . . . , and U [M] along the side 203 from the side 205 toward the side 204.

The circuit mounting area 332 is located along the side 203 on the side 202 side of the circuit mounting area 331, in the circuit block 330. In the circuit mounting area 332, the transmission gates TG [j+1] to TG [M] corresponding to the ejecting portions 600 [*j*+1] to 600 [M] among the M ejecting portions 600 [1] to 600 [M] are located side by side in order of the transmission gate TG [j+1], TG [j+2], . . . , and TG [M] along the side 203 from the side 205 toward the side 204.

The circuit mounting area 333 is located along the side 203 on the side 202 side of the circuit mounting area 332, in the circuit block 330. In the circuit mounting area 333, the decoders DC [j+1] to DC [M] corresponding to the ejecting portions 600 [*j*+1] to 600 [M] among the M ejecting portions 600 [1] to 600 [M] are located side by side in order of the decoders DC [j+1], DC [j+2], . . . , and DC [M] along the side 203 from the side 205 toward the side 204.

The circuit mounting area 334 is located along the side 203 on the side 202 side of the circuit mounting area 333, in the circuit block 330. In the circuit mounting area 334, the shift registers SR [j+1] to SR [M] corresponding to the ejecting portions 600 [*j*+1] to 600 [M] among the M ejecting portions 600 [1] to 600 [M] are located side by side in order of the shift registers SR [j+1], SR [j+2], . . . , and SR [M] along the side 203 from the side 205 toward the side 204.

As described above, the circuit block 330 includes the transmission gates TG [j+1] to TG [M] which switches whether or not to supply the drive signal Vin [j+1] to Vin [M] based on the drive signal COM to the piezoelectric elements 60 [*j*+1] to 60 [M] included in the ejecting portions 600 [*j*+1] to 600 [M], and the decoders DC [j+1] to DC [M] and the shift registers SR [j+1] to SR [M] for controlling the switching of the transmission gates TG [j+1] to TG [M], and the transmission gates TG [j+1] to TG [M] are located so that the shortest distance between the transmission gates TG [j+1] to TG [M] and the side 203 is smaller than the shortest distance between the decoders DC [j+1] to DC [M] and the shift registers SR [j+1] to SR [M], and the side 203.

Further, as illustrated in FIG. 13, in the integrated circuit 201, the terminals 341 [*j*+1] to 341 [M], the terminals 342 [*j*+1] to 342 [M], the terminals 343 [*j*+1] to 343 [M], and the terminals 344 [*j*+1] to 344 [M] are located at the terminal mounting surface 207 corresponding to an area in which the circuit block 330 of the terminal mounting surface 207 is located.

Each of the terminals 341 [*j*+1] to 341 [M] is electrically coupled to each of the changeover switches U [j+1] to U [M] and each of the piezoelectric elements 60 [*j*+1] to 60 [M] included in the ejecting portions 600 [*j*+1] to 600 [M]. That is, the terminal 341 [*j*+1] outputs the drive signal Vin [j+1] to be supplied to the piezoelectric element 60 [*j*+1] from the integrated circuit 201, and inputs the residual vibration Vout [j+1] to the integrated circuit 201. In the same manner, the terminal 341 [M] outputs the drive signal Vin [M] to be supplied to the piezoelectric element 60 [M] from the integrated circuit 201, and inputs the residual vibration Vout [M] to the integrated circuit 201. The respective terminals 341 [*j*+1] to 341 [M] are located side by side in order of the terminals 341 [j+1], 341 [*j*+2], . . . , and 341 [M] in the direction from the side 205 to the side 204 along the side 203.

Each of the terminals 342 [*j*+1] to 342 [M] is electrically coupled to the transmission gate TGa included in each of the transmission gates TG [j+1] to TG [M]. The drive signal Com-B is supplied to the transmission gate TGa via each of the terminals 342 [*j*+1] to 342 [M]. The respective terminals 342 [*j*+1] to 342 [M] are located on the side 203 side of the terminals 341 [*j*+1] to 341 [M] provided side by side along the side 203, and are located side by side in order of the terminals 342 [*j*+1], 342 [*j*+2], . . . , and 342 [M] in the direction from the side 205 to the side 204.

Each of the terminals 343 [*j*+1] to 343 [M] is electrically coupled to the transmission gate TGb included in each of the transmission gates TG [j+1] to TG [M]. The drive signal Com-B is supplied to the transmission gate TGb via each of the terminals 343 [*j*+1] to 343 [M]. The respective terminals 343 [j+1] to 343 [M] are located on the side 202 side of the terminals 342 [j+1] to 342 [M] provided side by side along the side 203, and are located side by side in order of the terminals 343 [j+1], 343 [j+2], . . . , and 343 [M] in the direction from the side 205 to the side 204.

Each of the terminals 344 [j+1] to 344 [M] is electrically coupled to the transmission gate TGc included in each of the transmission gates TG [j+1] to TG [M]. The drive signal Com-C is supplied to the transmission gate TGc via each of the terminals 344 [j+1] to 344 [M]. The respective terminals 344 [j+1] to 344 [M] are located on the side 202 side of the terminals 343 [j+1] to 343 [M] provided side by side along the side 203, and are located side by side in order of the terminals 344 [j+1], 344 [j+2], . . . , and 344 [M] in the direction from the side 205 to the side 204.

Here, any one of the piezoelectric elements 60 [j+1] to 60 [M] included in the ejecting portions 600 [j+1] to 600 [M] is an example of a third piezoelectric element and a third capacitive load, and the piezoelectric elements 60 [j+1] to 60 [M] are an example of a third piezoelectric element group and a third capacitive load group. The terminals 341 [j+1] to 341 [M] located along the side 203 and electrically coupled to the piezoelectric elements 60 [j+1] to 60 [M] among the plurality of piezoelectric elements 60 are an example of a third terminal group.

As described above, the circuit blocks 310, 320, and 330 include the M shift registers SR, the M decoders DC, the M transmission gates TG, and the M changeover switches U corresponding to the M ejecting portions 600 included in the drive signal selection control circuit 200 are located.

As illustrated in FIG. 12, the circuit block 340 includes an input and output circuit IO, a digital circuit area DB, and an analog circuit area AB.

The input and output circuit IO includes an input and output interface circuit to which the print data signal SI, the change signal CH, the latch signal LAT, the clock signal SCK, the switching control signal Sw, the voltages VDD and VHV, and the ground signal GND are input from the control mechanism 10, and which outputs the residual vibration signal NVT to the control mechanism 10.

The digital circuit area DB includes a gate array circuit which performs various digital processes in the integrated circuit 201. The digital circuit configured with the gate array circuit provided in the digital circuit area DB performs a buffering process of the print data signal SI, the change signal CH, the latch signal LAT, the clock signal SCK, and the switching control signal Sw input from the control mechanism 10, control of an output timing at which the print data signal SI, the change signal CH, the latch signal LAT, the clock signal SCK, and the switching control signal Sw is output to the drive signal selection control circuit 200, or the like.

The analog circuit area AB includes an analog circuit such as the residual vibration detection circuit 52 which detects the residual vibration Vout generated after the drive signal Vin based on the drive signal COM is supplied to the plurality of piezoelectric elements 60, a power-on reset circuit which resets the operation of the integrated circuit 201 according to a voltage value of a power supply voltage supplied to the integrated circuit 201, or an internal voltage generation circuit which outputs an internal voltage used inside the integrated circuit 201.

That is, the circuit block 340 includes an analog circuit which is a circuit for operating according to a signal input from the input and output circuit IO or generating a signal to be output from the input and output circuit IO, specifically, such as the residual vibration detection circuit 52, a power-on reset circuit, an internal voltage generation circuit, and a digital circuit such as a gate array circuit.

Further, as illustrated in FIG. 13, in the integrated circuit 201, a plurality of terminals 345 provided side by side along the side 203 are located at the terminal mounting surface 207 corresponding to an area in which the circuit block 340 of the terminal mounting surface 207 is located. Specifically, the plurality of terminals 345 provided side by side along the side 203 are located on the side 205 side of the terminals 341 [1] to 341 [i] provided side by side along the side 203, corresponding to the circuit block 310, and are located on the side 204 side of the terminals 341 [j+1] to 341 [M] provided side by side along the side 203, corresponding to the circuit block 330. In other words, the plurality of terminals 345 provided side by side along the side 203 are located between the terminals 341 [1] to 341 [i] provided side by side along the side 203, corresponding to the circuit block 310 and the terminals 341 [j+1] to 341 [M] provided side by side along the side 203, corresponding to the circuit block 330.

The plurality of terminals 345 includes an input terminal for inputting the print data signal SI, the change signal CH, the latch signal LAT, the clock signal SCK, the switching control signal Sw, the voltages VDD and VHV, and the ground signal GND to the integrated circuit 201 via the input and output circuit IO, and an output terminal for outputting the residual vibration signal NVT from the integrated circuit 201 via the input and output circuit IO. Each circuit included in the circuit blocks 310, 320, 330, and 340 operates based on the signal input from the input terminal among the plurality of terminals 345, and a signal according to the operation of each circuit included in the circuit blocks 310, 320, 330, and 340 is output from the output terminal among the plurality of terminals 345. The plurality of terminals 345 are an example of a fourth terminal group.

Further, as illustrated in FIGS. 12 and 13, the integrated circuit 201 includes buffer areas BS1, BS2, and BS3 in which no circuit element is provided. The buffer areas BS1, BS2, and BS3 are areas for reducing signal interference between the respective circuit blocks 310, 320, 330, and 340.

Specifically, the buffer area BS1 is located between the circuit block 310 and the circuit block 340, and the buffer area BS3 is located between the circuit block 330 and the circuit block 340. That is, the circuit blocks 310, 330, 340 and the buffer areas BS1 and BS3 are located side by side in order of the circuit block 310, the buffer area BS1, the circuit block 340, the buffer area BS3, and the circuit block 330 from the side 204 toward the side 205, along the side 203 in the integrated circuit 201.

Further, the buffer area BS2 is located between the circuit block 320 and the circuit block 340. That is, the circuit blocks 320 and 340 and the buffer area BS2 are located side by side in order of the circuit block 320, the buffer area BS2, and the circuit block 330, along the side 204 from the side 202 toward the side 203, in the integrated circuit 201.

In this case, a length of the buffer area BS2 in a direction along the side 204 is longer than a length of the buffer area BS1 in a direction along the side 203, and a length of the buffer area BS2 in a direction along the side 204 is longer than a length of the buffer area BS3 in a direction along the side 203. That is, the shortest distance from the circuit block 320 to the circuit block 340 between which the buffer area BS2 is located is shorter than the shortest distance from the circuit block 310 to the circuit block 340 between which the buffer area BS1 is located, and the shortest distance from the circuit block 320 to the circuit block 340 between which the buffer area BS2 is located is shorter than the shortest distance from the circuit block 330 to the circuit block 340 between which the buffer area BS3 is located.

Here, the buffer area BS2 is an example of a first buffer area, the buffer area BS1 is an example of a second buffer area, and the buffer area BS3 is an example of a third buffer area.

5. Action Effect

In the integrated circuit 201 provided in the print head 21 included in the liquid ejecting apparatus 1 according to the present embodiment configured as described above, among the M shift registers SR, the M decoders DC, the M transmission gates TG, and the M changeover switches U corresponding to the M ejecting portions 600 included in the drive signal selection control circuit 200, the shift registers SR [1] to SR [i], the decoders DC [1] to DC [i], the transmission gates TG [1] to TG [i], and the changeover switches U [1] to U [i] corresponding to the ejecting portions 600 [1] to 600 [*i*] are provided in the circuit block 310, the shift registers SR [i+1] to SR [j], the decoders DC [i+1] to DC [j], the transmission gates TG [i+1] to TG [j], and the changeover switches U [i+1] to U [j] corresponding to the ejecting portions 600 [*i*+1] to 600 [*j*] are provided in the circuit block 320, and the shift registers SR [j+1] to SR [M], the decoders DC [j+1] to DC [M], the transmission gates TG [j+1] to TG [M], and the changeover switches U [j+1] to U [M] corresponding to the ejecting portions 600 [*j*+1] to 600 [M] are provided in the circuit block 330.

Further, in the circuit block 340, an analog circuit which is a circuit for operating according to a signal input from the input and output circuit IO or generating a signal to be output from the input and output circuit IO, such as the residual vibration detection circuit 52, a power-on reset circuit, an internal voltage generation circuit, and a digital circuit such as a gate array circuit are provided.

The buffer area BS1 in which no circuit element is provided is located between the circuit block 310 and the circuit block 340, and the buffer area BS2 in which no circuit element is provided is located between the circuit block 320 and the circuit block 340, and the buffer area BS3 in which no circuit element is provided is located between the circuit block 330 and the circuit block 340.

As a result, the buffer areas BS1, BS2, and BS3 function as shield members, and as a result, a possibility that a noise component such as switching noise occurring in the drive signal selection control circuit 200, which may increase due to an increase in the amount of current supplied to the integrated circuit 201, is superimposed on the analog circuit and the digital circuit provided in the circuit block 340 is reduced.

Therefore, even when the current supplied to the integrated circuit 201 increases, a possibility that the integrated circuit 201 malfunctions due to the noise component is reduced, and a possibility that the print head 21 and the liquid ejecting apparatus 1 including the integrated circuit 201 malfunction is reduced. That is, in the integrated circuit 201 provided in the print head 21 provided in the liquid ejecting apparatus 1 according to the present embodiment, even when the amount of input current increases, the possibility that the integrated circuit 201, the print head 21 including the integrated circuit 201, and the liquid ejecting apparatus 1 including the print head 21 malfunction is reduced.

Further, in the integrated circuit 201 provided in the print head 21 included in the liquid ejecting apparatus 1 according to the present embodiment, since a signal having a voltage sufficient to drive the piezoelectric element 60 is input to the transmission gate TG, a large current flows in each configuration included in the drive signal selection control circuit 200. Since the transmission gate TG is a circuit which selects or does not select the waveform included in the drive signal COM, a large noise component is generated in each configuration included in the drive signal selection control circuit 200.

In the circuit block 320, the transmission gate TG, through which a large current may flow and in which a large noise component may be generated, is located on the side 202 side facing the side 203 in which the circuit block 340 is provided, so that a possibility that the noise components such as switching noise occurring in the circuit block 320, which may increase due to an increase in the amount of current supplied to the integrated circuit 201, is superimposed on the analog circuit and the digital circuit provided in the circuit block 340 is further reduced.

That is, in the circuit block 320, the transmission gates TG [i+1] to TG [j] are located so that the shortest distance between the transmission gates TG [i+1] to TG [j] and the side 202 is smaller than the shortest distance between the decoders DC [i+1] to DC [j] and the shift registers SR [i+1] to SR [j], and the side 203, so that a possibility that the noise component such as switching noise occurring in the circuit block 320 is superimposed on the analog circuits and the digital circuit provided in the circuit block 340 is further reduced.

Further, in this case, the shortest distance from the circuit block 320 to the circuit block 340 between which the buffer area BS2 is located is shorter than the shortest distance from the circuit block 310 to the circuit block 340 between which the buffer area BS1 is located, and the shortest distance from the circuit block 320 to the circuit block 340 between which the buffer area BS2 is located is shorter than the shortest distance from the circuit block 330 to the circuit block 340 between which the buffer area BS3 is located, so that while reducing the possibility of the integrated circuit 201 becoming larger, the possibility that the noise components such as switching noise occurring in the circuit blocks 310 and 330 are superimposed on the analog circuit and the digital circuit provided in the circuit block 340 is further reduced.

The transmission gates TG included in the respective circuit blocks 310 and 330 are located side by side in a direction along the side 203. Further, the circuit blocks 310, 320, and 340 are located side by side in the direction along the side 203. Therefore, it is difficult to provide the transmission gate TG included in each of the circuit blocks 310 and 330 farther from the circuit block 340. Therefore, in order to further reduce the possibility that noise components such as switching noise occurring in the circuit blocks 310 and 330 are superimposed on the analog circuit and the digital circuit provided in the circuit block 340, it is required to widen the buffer area BS1 located between the circuit block 310 and the circuit block 340, and to widen the buffer area BS3 located between the circuit block 330 and the circuit block 340. Meanwhile, when the buffer area BS1 located between the circuit block 310 and the circuit block 340 is widened and the buffer area BS3 located between the circuit block 330 and the circuit block 340 is widened, it becomes difficult to miniaturize the integrated circuit 201.

Therefore, in the integrated circuit 201 provided in the print head 21 included in the liquid ejecting apparatus 1 according to the present embodiment, in the circuit block 320, the transmission gates TG [i+1] to TG [j] are located so that the shortest distance between the transmission gates TG [i+1] to TG [j] and the side 202 is smaller than the shortest distance between the decoders DC [i+1] to DC [j] and the shift registers SR [i+1] to SR [j], and the side 203, so that it is possible to reduce the possibility that the noise components such as switching noise occurring in the circuit block 320 are superimposed on the analog circuit and the digital circuit provided in the circuit block 340 and to reduce the buffer area BS2 located between the circuit block 320 and the circuit block 340. Further, while reducing the possibility that the integrated circuit 201 becomes larger by widening the buffer area BS1 located between the circuit block 310 and the circuit block 340 and widening the buffer area BS3 located between the circuit block 330 and the circuit block 340, it is possible to further reduce the possibility that the noise components such as switching noise occurring in the circuit blocks 310 and 330 are superimposed on the analog circuit and the digital circuit provided in the circuit block 340.

The embodiments and the modification examples are described above, but the present disclosure is not limited to the present embodiment, and can be implemented in various aspects without departing from a gist thereof. For example, the above embodiments can be combined as appropriate.

The present disclosure includes substantially the same configuration as the configuration described in the embodiment (for example, a configuration having the same function, method and result or a configuration having the same object and effect). In addition, the present disclosure includes a configuration in which non-essential parts of the configuration described in the embodiment are replaced. Further, the present disclosure includes a configuration which achieves the same action and effect as the configuration described in the embodiment or a configuration which can achieve the same object. In addition, the present disclosure includes a configuration in which a known technology is added to the configuration described in the embodiment.

The following contents are derived from the above-described embodiments and modification examples.

There is provided an aspect of a print head including: a plurality of piezoelectric elements to be driven by supply of drive signals; an integrated circuit apparatus that switches whether or not to supply the drive signal to the plurality of piezoelectric elements; and a wiring substrate in which the drive signal propagates and the integrated circuit apparatus is provided, in which the integrated circuit apparatus includes a first side, a second side located facing the first side, a first terminal group located along the first side and electrically coupled to a first piezoelectric element group including a first piezoelectric element among the plurality of piezoelectric elements, a second terminal group located along the second side and electrically coupled to a second piezoelectric element group including a second piezoelectric element among the plurality of piezoelectric elements, a third terminal group located along the second side and electrically coupled to a third piezoelectric element group including a third piezoelectric element among the plurality of piezoelectric elements, a fourth terminal group located between the second terminal group and the third terminal group along the second side and including an input terminal and an output terminal, a first circuit block that switches whether or not to supply the drive signal from the first terminal group to the first piezoelectric element group, a second circuit block that switches whether or not to supply the drive signal from the second terminal group to the second piezoelectric element group, a third circuit block that switches whether or not to supply the drive signal from the third terminal group to the third piezoelectric element group, a fourth circuit block that operates according to a signal input from the input terminal or outputs a signal from the output terminal, and a first buffer area, a second buffer area, and a third buffer area in which no circuit element is located, the first buffer area is located between the first circuit block and the fourth circuit block, the second buffer area is located between the second circuit block and the fourth circuit block, and the third buffer area is located between the third circuit block and the fourth circuit block.

According to this print head, in the integrated circuit apparatus, the first buffer area in which no circuit element is located is located between the first circuit block which switches whether or not to supply the drive signal from the first terminal group electrically coupled to the first piezoelectric element group to the first piezoelectric element group and the fourth circuit block which operates according to the signal input from the input terminal or outputs the signal from the output terminal, the second buffer area in which no circuit element is located is located between the second circuit block which switches whether or not to supply the drive signal from the second terminal group electrically coupled to the second piezoelectric element group to the second piezoelectric element group and the fourth circuit block, and the third buffer area in which no circuit element is located is located between the third circuit block which switches whether or not to supply the drive signal from the third terminal group electrically coupled to the third piezoelectric element group to the third piezoelectric element group and the fourth circuit block.

Since each of the first circuit block, the second circuit block, and the third circuit block switches whether or not to supply the drive signal to the first piezoelectric element group, the second piezoelectric element group, and the third piezoelectric element group, when the number of piezoelectric elements driven by the drive signal increases, there is a possibility that a large current flows and a large switching noise occurs, as a result. By locating the first buffer area, the second buffer area, and the third buffer area in which no circuit element is located between each of the first circuit block, the second circuit block, and the third circuit block and the fourth circuit block for operating according to the signal input from the input terminal or outputting the signal from the output terminal, each of the first buffer area, the second buffer area, and the third buffer area functions as a shield member which reduces the switching noise, and as a result, a possibility that the switching noise occurring in the first circuit block, the second circuit block, and the third circuit block affects the fourth circuit block is reduced. Therefore, the possibility that the integrated circuit apparatus through which a large current flows malfunctions is reduced, and as a result, the possibility that the print head malfunctions is reduced.

In one aspect of the print head, the integrated circuit apparatus may include a third side which intersects both the first side and the second side, and a fourth side which intersects both the first side and the second side and is located facing the third side, the first circuit block may be located along the first side, and the second circuit block, the third circuit block, and the fourth circuit block may be located side by side in order of the second circuit block, the fourth circuit block, and the third circuit block from the third side toward the fourth side along the second side.

In one aspect of the print head, the fourth circuit block may include a residual vibration detection circuit which detects a residual vibration generated after the drive signal is supplied to the plurality of piezoelectric elements.

Since the residual vibration is a signal having a small voltage value generated after the drive signal is supplied to the piezoelectric element, detection accuracy is lowered when a noise is superimposed. According to this print head, the residual vibration detection circuit for detecting the residual vibration is located in the fourth circuit block, so that the possibility that the switching noise occurring in the first circuit block, the second circuit block, and the third circuit block affects the residual vibration detection circuit is reduced Therefore, the possibility that the detection accuracy of the residual vibration in the residual vibration detection circuit is lowered due to the noise component is reduced. Therefore, the possibility that the integrated circuit apparatus malfunctions is further reduced, and as a result, the possibility that the print head malfunctions is further reduced.

In one aspect of the print head, the fourth circuit block may include a power-on reset circuit which resets an operation of the integrated circuit apparatus according to a voltage value of a power supply voltage supplied to the integrated circuit apparatus.

According to this print head, by locating the power-on reset circuit in the fourth circuit block, the possibility that the switching noise occurring in the first circuit block, the second circuit block, and the third circuit block affects the power-on reset circuit is reduced. Therefore, the possibility that the power-on reset circuit malfunctions due to the noise component is reduced. Therefore, the possibility that the integrated circuit apparatus malfunctions is further reduced, and as a result, the possibility that the print head malfunctions is further reduced.

In one aspect of the print head, the fourth circuit block may include an internal voltage generation circuit which outputs an internal voltage used inside the integrated circuit apparatus.

According to this print head, by locating the internal voltage generation circuit in the fourth circuit block, the possibility that the switching noise occurring in the first circuit block, the second circuit block, and the third circuit block affects the internal voltage generation circuit is reduced Therefore, the possibility that the voltage value of the internal voltage used inside the integrated circuit apparatus fluctuates is reduced. Therefore, the possibility that the integrated circuit apparatus malfunctions is further reduced, and as a result, the possibility that the print head malfunctions is further reduced.

In one aspect of the print head, the first circuit block may include a switch circuit which switches whether or not to supply the drive signal from the first terminal group to the first piezoelectric element group, and a switching control circuit which controls the switching of the switch circuit, and a shortest distance between the switch circuit and the first side may be shorter than a shortest distance between the switching control circuit and the first side.

According to this print head, the switch circuit, included in the first circuit block, which switches whether or not to supply the drive signal to the first piezoelectric element group can be located farther from the fourth circuit block than the switching control circuit which controls the switching of the switch circuit. Therefore, the possibility that the switching noise occurring in the first circuit block affects the fourth circuit block is further reduced. Therefore, the possibility that the integrated circuit apparatus malfunctions is further reduced, and as a result, the possibility that the print head malfunctions is further reduced.

In one aspect of the print head, a shortest distance between the first circuit block and the fourth circuit block may be shorter than a shortest distance between the second circuit block and the fourth circuit block.

According to this print head, by locating the switch circuit, included in the first circuit block, which switches whether or not to supply the drive signal to the first piezoelectric element group is located farther from the fourth circuit block, the possibility that the switching noise occurring in the first circuit block affects the fourth circuit block is reduced, so that the shortest distance between the first circuit block and the fourth circuit block can be shorter than the shortest distance between the second circuit block and the fourth circuit block. As a result, it is possible to reduce the possibility of the integrated circuit apparatus becoming large while reducing the possibility that the integrated circuit apparatus malfunctions. Therefore, it is possible to reduce the possibility of the print head becoming large while reducing the possibility that the print head malfunctions.

There is provided an aspect of a liquid ejecting apparatus including: a drive signal output circuit that outputs drive signals; and a print head that ejects liquid based on the drive signal, in which the print head includes a plurality of piezoelectric elements to be driven by supply of the drive signals, an integrated circuit apparatus that switches whether or not to supply the drive signal to the plurality of piezoelectric elements, and a wiring substrate in which the drive signal propagates and the integrated circuit apparatus is provided, the integrated circuit apparatus includes a first side, a second side located facing the first side, a first terminal group located along the first side and electrically coupled to a first piezoelectric element group including a first piezoelectric element among the plurality of piezoelectric elements, a second terminal group located along the second side and electrically coupled to a second piezoelectric element group including a second piezoelectric element among the plurality of piezoelectric elements, a third terminal group located along the second side and electrically coupled to a third piezoelectric element group including a third piezoelectric element among the plurality of piezoelectric elements, a fourth terminal group located between the second terminal group and the third terminal group along the second side and including an input terminal and an output terminal, a first circuit block that switches whether or not to supply the drive signal from the first terminal group to the first piezoelectric element group, a second circuit block that switches whether or not to supply the drive signal from the second terminal group to the second piezoelectric element group, a third circuit block that switches whether or not to supply the drive signal from the third terminal group to the third piezoelectric element group, a fourth circuit block that operates according to a signal input from the input terminal or outputs a signal from the output terminal, and a first buffer area, a second buffer area, and a third buffer area in which no circuit element is located, the first buffer area is located between the first circuit block and the fourth circuit block, the second buffer area is located between the second circuit block and the fourth circuit block, and the third buffer area is located between the third circuit block and the fourth circuit block.

According to this liquid ejecting apparatus, in the integrated circuit apparatus included in the print head, the first buffer area in which no circuit element is located is located between the first circuit block which switches whether or not to supply the drive signal from the first terminal group electrically coupled to the first piezoelectric element group to the first piezoelectric element group and the fourth circuit block which operates according to the signal input from the input terminal or outputs the signal from the output terminal, the second buffer area in which no circuit element is located is located between the second circuit block which switches whether or not to supply the drive signal from the second terminal group electrically coupled to the second piezoelectric element group to the second piezoelectric element group and the fourth circuit block, and the third buffer area in which no circuit element is located is located between the third circuit block which switches whether or not to supply the drive signal from the third terminal group electrically coupled to the third piezoelectric element group to the third piezoelectric element group and the fourth circuit block.

Since each of the first circuit block, the second circuit block, and the third circuit block switches whether or not to supply the drive signal to the first piezoelectric element group, the second piezoelectric element group, and the third piezoelectric element group, when the number of piezoelectric elements driven by the drive signal increases, there is a possibility that a large current flows and a large switching noise occurs, as a result. By locating the first buffer area, the second buffer area, and the third buffer area in which no circuit element is located between each of the first circuit block, the second circuit block, and the third circuit block and the fourth circuit block for operating according to the signal input from the input terminal or outputting the signal from the output terminal, each of the first buffer area, the second buffer area, and the third buffer area functions as a shield member which reduces the switching noise, and as a result, a possibility that the switching noise occurring in the first circuit block, the second circuit block, and the third circuit block affects the fourth circuit block is reduced. Therefore, the possibility that the integrated circuit apparatus through which a large current flows malfunctions is reduced, and as a result, the possibility that the liquid ejecting apparatus including the print head including the integrated circuit apparatus malfunctions is reduced.

There is provided an aspect of a capacitive load drive integrated circuit apparatus which switches whether or not to supply drive signals to a plurality of capacitive loads to be driven by supply of the drive signals to control driving of the plurality of capacitive loads, the capacitive load drive integrated circuit apparatus including: a first side, a second side located facing the first side, a first terminal group located along the first side and electrically coupled to a first capacitive load group including a first capacitive load among the plurality of capacitive loads; a second terminal group located along the second side and electrically coupled to a second capacitive load group including a second capacitive load among the plurality of capacitive loads; a third terminal group located along the second side and electrically coupled to a third capacitive load group including a third capacitive load among the plurality of capacitive loads; a fourth terminal group located between the second terminal group and the third terminal group along the second side and including an input terminal and an output terminal, a first circuit block that switches whether or not to supply the drive signal from the first terminal group to the first capacitive load group; a second circuit block that switches whether or not to supply the drive signal from the second terminal group to the second capacitive load group; a third circuit block that switches whether or not to supply the drive signal from the third terminal group to the third capacitive load group; a fourth circuit block that operates according to a signal input from the input terminal or outputs a signal from the output terminal, and a first buffer area, a second buffer area, and a third buffer area in which no circuit element is located, in which the first buffer area is located between the first circuit block and the fourth circuit block, the second buffer area is located between the second circuit block and the fourth circuit block, and the third buffer area is located between the third circuit block and the fourth circuit block.

According to this capacitive load drive integrated circuit apparatus, the first buffer area in which no circuit element is located is located between the first circuit block which switches whether or not to supply the drive signal from the first terminal group electrically coupled to the first capacitive load group to the first capacitive load group and the fourth circuit block which operates according to the signal input from the input terminal or outputs the signal from the output terminal, the second buffer area in which no circuit element is located is located between the second circuit block which switches whether or not to supply the drive signal from the second terminal group electrically coupled to the second capacitive load group to the second capacitive load group and the fourth circuit block, and the third buffer area in which no circuit element is located is located between the third circuit block which switches whether or not to supply the drive signal from the third terminal group electrically coupled to the third capacitive load group to the third capacitive load group and the fourth circuit block.

Since each of the first circuit block, the second circuit block, and the third circuit block switches whether or not to supply the drive signal to the first capacitive load group, the second capacitive load group, and the third capacitive load group, when the number of capacitive loads driven by the drive signal increases, there is a possibility that a large current flows and a large switching noise occurs, as a result. By locating the first buffer area, the second buffer area, and the third buffer area in which no circuit element is located between each of the first circuit block, the second circuit block, and the third circuit block and the fourth circuit block for operating according to the signal input from the input terminal or outputting the signal from the output terminal, each of the first buffer area, the second buffer area, and the third buffer area functions as a shield member which reduces the switching noise, and as a result, a possibility that the switching noise occurring in the first circuit block, the second circuit block, and the third circuit block affects the fourth circuit block is reduced. Therefore, the possibility that the integrated circuit apparatus through which a large current flows malfunctions is reduced.

What is claimed is:

1. A print head comprising:

a plurality of piezoelectric elements to be driven by supply of drive signals;

an integrated circuit apparatus that switches whether or not to supply the drive signal to the plurality of piezoelectric elements; and a wiring substrate in which the drive signal propagates and the integrated circuit apparatus is provided, wherein the integrated circuit apparatus includes a first side, a second side located facing the first side, a first terminal group located along the first side and electrically coupled to a first piezoelectric element group including a first piezoelectric element among the plurality of piezoelectric elements, a second terminal group located along the second side and electrically coupled to a second piezoelectric element group including a second piezoelectric element among the plurality of piezoelectric elements, a third terminal group located along the second side and electrically coupled to a third piezoelectric element group including a third piezoelectric element among the plurality of piezoelectric elements, a fourth terminal group located between the second terminal group and the third terminal group along the second side and including an input terminal and an output terminal, a first circuit block that switches whether or not to supply the drive signal from the first terminal group to the first piezoelectric element group, a second circuit block that switches whether or not to supply the drive signal from the second terminal group to the second piezoelectric element group, a third circuit block that switches whether or not to supply the drive signal from the third terminal group to the third piezoelectric element group, a fourth circuit block that operates according to a signal input from the input terminal or outputs a signal from the output terminal, and a first buffer area, a second buffer area, and a third buffer area in which no circuit element is located, the first buffer area is located between the first circuit block and the fourth circuit block, the second buffer area is located between the second circuit block and the fourth circuit block, and the third buffer area is located between the third circuit block and the fourth circuit block.

2. The print head according to claim 1, wherein the integrated circuit apparatus includes a third side which intersects both the first side and the second side, and a fourth side which intersects both the first side and the second side and is located facing the third side, the first circuit block is located along the first side, and the second circuit block, the third circuit block, and the fourth circuit block are located side by side in order of the second circuit block, the fourth circuit block, and the third circuit block from the third side toward the fourth side along the second side.

3. The print head according to claim 1, wherein the fourth circuit block includes a residual vibration detection circuit which detects a residual vibration generated after the drive signal is supplied to the plurality of piezoelectric elements.

4. The print head according to claim 1, wherein the fourth circuit block includes a power-on reset circuit which resets an operation of the integrated circuit apparatus according to a voltage value of a power supply voltage supplied to the integrated circuit apparatus.

5. The print head according to claim 1, wherein the fourth circuit block includes an internal voltage generation circuit which outputs an internal voltage used inside the integrated circuit apparatus.

6. The print head according to claim 1, wherein the first circuit block includes a switch circuit which switches whether or not to supply the drive signal from the first terminal group to the first piezoelectric element group, and a switching control circuit which controls the switching of the switch circuit, and a shortest distance between the switch circuit and the first side is shorter than a shortest distance between the switching control circuit and the first side.

7. The print head according to claim 6, wherein a shortest distance between the first circuit block and the fourth circuit block is shorter than a shortest distance between the second circuit block and the fourth circuit block.

8. A liquid ejecting apparatus comprising:

a drive signal output circuit that outputs drive signals; and a print head that ejects liquid based on the drive signal, wherein the print head includes a plurality of piezoelectric elements to be driven by supply of the drive signals, an integrated circuit apparatus that switches whether or not to supply the drive signal to the plurality of piezoelectric elements, and a wiring substrate in which the drive signal propagates and the integrated circuit apparatus is provided, the integrated circuit apparatus includes a first side, a second side located facing the first side, a first terminal group located along the first side and electrically coupled to a first piezoelectric element group including a first piezoelectric element among the plurality of piezoelectric elements, a second terminal group located along the second side and electrically coupled to a second piezoelectric element group including a second piezoelectric element among the plurality of piezoelectric elements, a third terminal group located along the second side and electrically coupled to a third piezoelectric element group including a third piezoelectric element among the plurality of piezoelectric elements, a fourth terminal group located between the second terminal group and the third terminal group along the second side and including an input terminal and an output terminal, a first circuit block that switches whether or not to supply the drive signal from the first terminal group to the first piezoelectric element group, a second circuit block that switches whether or not to supply the drive signal from the second terminal group to the second piezoelectric element group, a third circuit block that switches whether or not to supply the drive signal from the third terminal group to the third piezoelectric element group, a fourth circuit block that operates according to a signal input from the input terminal or outputs a signal from the output terminal, and a first buffer area, a second buffer area, and a third buffer area in which no circuit element is located, the first buffer area is located between the first circuit block and the fourth circuit block, the second buffer area is located between the second circuit block and the fourth circuit block, and the third buffer area is located between the third circuit block and the fourth circuit block.

9. A capacitive load drive integrated circuit apparatus which switches whether or not to supply drive signals to a plurality of capacitive loads to be driven by supply of the drive signals to control driving of the plurality of capacitive loads, the capacitive load drive integrated circuit apparatus comprising:

a first side;

a second side located facing the first side;

a first terminal group located along the first side and electrically coupled to a first capacitive load group including a first capacitive load among the plurality of capacitive loads;

a second terminal group located along the second side and electrically coupled to a second capacitive load group including a second capacitive load among the plurality of capacitive loads;

a third terminal group located along the second side and electrically coupled to a third capacitive load group including a third capacitive load among the plurality of capacitive loads;

a fourth terminal group located between the second terminal group and the third terminal group along the second side and including an input terminal and an output terminal;

a first circuit block that switches whether or not to supply the drive signal from the first terminal group to the first capacitive load group;

a second circuit block that switches whether or not to supply the drive signal from the second terminal group to the second capacitive load group;

a third circuit block that switches whether or not to supply the drive signal from the third terminal group to the third capacitive load group;

a fourth circuit block that operates according to a signal input from the input terminal or outputs a signal from the output terminal; and a first buffer area, a second buffer area, and a third buffer area in which no circuit element is located, wherein the first buffer area is located between the first circuit block and the fourth circuit block, the second buffer area is located between the second circuit block and the fourth circuit block, and the third buffer area is located between the third circuit block and the fourth circuit block.

* * * * *